US006017597A

United States Patent [19]

Minakami et al.

[11] Patent Number: 6,017,597

[45] Date of Patent: Jan. 25, 2000

[54] COMPLEX CELL STRUCTURE AND METHOD FOR PRODUCING THE SAME

[76] Inventors: Hiroyuki Minakami, 1-1, Nishiokamoto 2-Chome,Higashinada-ku, Kobe-shi, Hyogo 658; Motoyuki Minakami, 201 Tou 104, 12-2, Kasuga 1-Chome, Tsukuba-shi, Ibaraki 350, both of Japan

[21] Appl. No.: 08/849,235

[22] PCT Filed: Jan. 27, 1995

[86] PCT No.: PCT/JP95/00108

§ 371 Date: Aug. 5, 1997

§ 102(e) Date: Aug. 5, 1997

[87] PCT Pub. No.: WO96/23163

PCT Pub. Date: Aug. 1, 1996

[51] Int. Cl.[7] ..... B32B 3/12; B32B 5/18; E04C 3/34

[52] U.S. Cl. ..... 428/34.4; 428/34.6; 428/34.7; 428/36.91; 428/117; 428/118; 428/174; 428/178; 428/188; 52/414; 52/576; 52/723.1; 52/737.4; 52/742.14; 156/78; 156/196; 156/290; 156/291; 156/269

[58] Field of Search ..... 428/174, 178, 428/188, 67, 68, 118, 34.4, 36.9, 36.91, 34.6, 34.7, 117; 52/576, 414, 783.1, 745.17, 723.1, 737.4, 742.14; 156/78, 79, 217, 196, 290, 269, 291

[56] References Cited

U.S. PATENT DOCUMENTS

| | | | |
|---|---|---|---|
| 3,016,315 | 1/1962 | Robinson | 154/45.9 |
| 3,388,509 | 6/1968 | Mora | 52/2 |
| 4,068,429 | 1/1978 | Moore | 52/204 |
| 4,495,237 | 1/1985 | Patterson | 428/178 |
| 4,875,622 | 10/1989 | Lents | 232/39 |
| 4,937,125 | 6/1990 | Sanmartin et al. | 428/116 |
| 5,505,030 | 4/1996 | Michalcewiz | 52/249 |
| 5,526,625 | 6/1996 | Emblin et al. | 52/437 |
| 5,599,606 | 2/1997 | Disselbeck | 428/156 |
| 5,615,528 | 4/1997 | Owens | 52/576 |
| 5,779,579 | 6/1998 | Jessup et al. | 428/73 |

FOREIGN PATENT DOCUMENTS

WO 95/20486 8/1995 WIPO .

OTHER PUBLICATIONS

"Sandwich Construction 1" Ed. Kar–l–Axel Olsson and Ronnal P. Reichard, 1989.

*Primary Examiner*—Rena L. Dye
*Attorney, Agent, or Firm*—Limbach & Limbach LLP

[57] ABSTRACT

The objectives of the invention is to obtain the complex cell structured material which has the advantages of toughness and of being light in weight. Also it is economical when utilized in the field of the general structural materials such as architecture, civil engineering, machinery structure field, automobiles, ships, cars, aircrafts, space crafts, space stations, submarines. The manufacturing of this invention also consists of simple procedures. A complex cell structure is comprised of a maintained spatial surface on which is the complex cell bodies are bonded. The complex cell bodies are distributed/bonded on the maintained spatial surface. The maintained spatial surface is rolled, annual ring shaped, whirlpooled, laminated, plate shaped or crossed. The liquid coagulant fills the empty space. The coagulant is coagulated to produce the complex cell structure. Also, the method to produce is as follows. Prepared complex cell bodies are composed of rigid sections and a light material. They are then processed to a preordained shape. They are distributed/bonded on the maintained spatial surface. The liquid coagulant fills the empty space. When the coagulant hardens, the process is complete.

23 Claims, 18 Drawing Sheets

COMPLEX CELL STRUCTURE AND METHOD FOR PRODUCING THE SAME

DESCRIPTION OF THE INVENTION

1. Field of the Invention

This invention is related to the general structural material involved in architecture (for example: pillars, walls, shielding, foundations or floors for tall buildings or pillars, wall shielding floors, for regular buildings and houses), the civil engineering field (for example; road facilities such as noise resistant walls and crash barriers, road paving materials, pipes, segment materials for tunnels, segment materials for underwater tunnels, tube structural materials, main beams of bridges, bridge floors, girders, cross beams of bridges, girder walls, piers, bridge substructures, towers, dikes and dams, guideways, railroads, ocean structures such as breakwaters and wharf protection for harbor facilities, floating piers/oil excavation or production platforms, airport structures such as runways) and the machine structure field (frame structures for carrying system, carrying pallets, frame structure for robots etc), the automobile (the body, frame, doors, chassis, roof and floor, side beams, bumpers etc), the ship (main frame of the ship, body, deck, partition wall, wall etc), freight car (body, frame, floor, wall etc), aircraft (wing, main frame, body, floor etc), spacecraft (body, frame, floor, wall etc), the space station (the main body, floor, wall etc), the submarine (the body, frame etc), and is related to the structural material which requires extreme dynamic strength.

2. Background of the Invention

In the fields of civil engineering, architecture, automobiles, ships and aircrafts, which require extreme dynamic strength, such as steel and concrete or metal such as aluminum, duralumin which are generally used as structural materials. These materials are used alone or are occasionally used in combinations each other. Also, carbon fiber is utilized.

For example, in the civil engineering and architecture fields, as a typical complex material, reinforced concrete is generally used. This reinforced concrete is the structural material which utilizes each character of steel and concrete. The concrete retains a low tension strength, and it's ratio is about 1 to 10, expansion to compression. In order to make up for this, steel materials such as reinforcing bar, which have a much higher strength of tension, is utilized, and it is distributed to the point which of action of tension, so that reinforced concrete comes to possess a high tolerance of dynamic action.

However, stability is not distributed effectively, a larger surface contact area of steel and concrete is needed for a more efficient and strong structure, from the spacing point of view. For example, concerning pre-stressed concrete, utilizing a large amount of strength against the pressing force of concrete and a great tension strength of the reinforcing bar, the concrete is pre-stressed by the bar to instill more compressive force from the beginning to reduce the tension force on the concrete.

The reason for explaining why the concrete and steel complex material is used in the civil engineering and architecture field is that the character of these materials supplement each other. These materials are relatively economical, widely used, easy to manufacture and process, have significantly strong loading tolerances, easy to adhere to each other, have near equal coefficients of thermal expansion, etc. Therefore a reciprocal dynamic action can be expected.

Concerning the aforementioned reinforced concrete complex material, there exists a concrete filled steel pipe structure. The concrete filled steel pipe structure is a steel pipe which is filled with concrete. This is mainly used for compressive materials. Recently, as it has been shown in the Japanese Published Unexamined Patent Application 20457/92, the steel net is used for making the concrete filled steel pipe structure to make complex materials, and the Japanese Published Unexamined Patent Application 28058192, 28059/92, producing a pre-stressed material by heating the steel pipe. Also, the construction method of the concrete filled steel pipe structure is by the treatment of unbinding inside of the steel pipe. Also, the new method of putting slits around the steel pipe to increase tolerance of the compressive force of the steel pipe, and such methods can be seen in Japanese Provisional Patent Application 49949/94. Recently, these new technologies have been in use for building tall buildings.

Furthermore, in order to decrease the weight of the structural material, light weight material such as fragments of urethane foam or light aggregates of sand or ballast or bubbles are mixed into the concrete. Also, there is a case that the urethane foam is utilized for civil engineering material, such as road construction material. In Japanese Published Unexamined Patent Application 33110/75, 33111/75, or in Japanese Unexamined Patent Application 9811/91, the case shows a process of making a variety of honeycomb structures.

In the field of the aircraft industry, which is required to use light weight material, a hexagon shaped cell is utilized such as the honeycombed structure made from duralumin or aluminum. Duralumin and aluminum are expensive materials. However, these are significantly lighter than steel or concrete. Thus, in case of using such expensive materials, the main issue would be how to minimize the use of such material.

The honeycomb structure is the set of polygons which have many planes and ridges. Usually, it is comprised of the hexagonal structure, and so called the honeycomb structure. Generally, duralumin or aluminum is used as the key material. Also, this structure is used as an intermediate material for the wing of the aircraft Recently, in the automobile structure, the honeycomb structure is used in the flooring. Also, in the architecture field, the honeycomb structure is used for building the tall buildings.

The reinforced concrete, which is generally used in the civil engineering and architectural fields, is typically a complex material. However, from the kinetic point of view, the area which is effected by the combination of steel and concrete is considerably limited to the area at which they contact one another.

For example, in the case of the destruction of reinforced concrete by a compressive force, first the concrete is destroyed by a sliding break, at the same time, generally, the steel bar is bent. The steel becomes weak when the surrounding concrete is removed. In the case of the complex material such as reinforced concrete, which is comprised of steel bar and concrete, the multiplication effect is available only around the limited area where the contact of steel and concrete exists. As a result, the multiplication effect is unevenly distributed in the material. Thus, the synergistic effect is not completely delivered as it is supposed to.

This is because the steel is used only as a bar in the concrete when it is used for reinforced concrete. To supplement this defect, a spiral bar is installed along the bar which is usually set longitudinally in order to prevent the shear destruction of the concrete. If the spiral bar is completely set along the longitudinal bar, the strength of the reinforced concrete is increased, but the weight of the structure itself becomes significantly heavier because of the heavy weight of the steel.

Concerning the structural strength of the concrete filled steel pipe, the steel has a high strength of tension and concrete is generally strong against compressive forces. If the structure exhibit a compressive force, even if the sliding break occurs in the concrete section, the steel pipe, which is rapping the concrete is tightening the concrete just like a hoop. Therefore, destruction does not occur, and it has a high tolerance against compressive forces as well as tension forces. However, as the steel pipe is completely filled with heavy concrete, it becomes considerably heavy. Therefore, it usually cannot be used for beams. Because of this defect, it is hard to utilize.

In light of the increasing demand for longer bridges and taller building, it is necessary to develop a new material which meets the requirements of project specifications. A new material which is lighter, stronger, more resistant to heavy loads, and less expensive is needed. With hits in mind, a simple production procedure for this material is necessary.

However, using current methods and standards, if a material is made lighter, it loses strength. For example, there is a method of concrete production designed for weight reduction. Mixing a light aggregate material with the concrete is the procedure. The drawback to this is that the structure's strength is compromised. The structure becomes uneven and unsecured; therefore, it's kinetic distribution is uneven.

Also, it is difficult to maintain when in a well mixed condition until it coagulated. Hence, this method produces little progress toward the ultimate goal of strengthening the structure while making the structure lighter.

In the automobile, aluminum and engineering plastics are used; and in the aircraft, duralumin and aluminum are used. These materials have a high ratio of load to weight compared to steel or concrete. But they are expensive material. For civil engineering and architectural uses, these are too expensive to use widely as a structural material.

The honeycomb structural material is utilized in aircraft production and area of architecture. It is used as a hollow structure. Generally the empty space inside is not filled with any material. Metal plates (aluminum, duralumin, etc) which are composed of the honeycomb structure have a tendency to buckle, bend, and slide. Once this destruction occurs, the load force functions locally or unevenly. Rapid displacement occurs and results in the sudden destruction of the total structure. In other words, the honeycomb structure has a weakness, it's toughness.

Up to now, in the civil engineering and architectural fields, concrete honeycomb structures have not been utilized. One of the reasons is that it is too complicated to produce such a structure. Also, it is necessary to assemble a formwork. Even with completion the cost will increase.

Moreover, there is another reason not to adopt the concrete honeycomb structure for general use: the concrete itself is less tolerant to tension forces. It has a tendency to crack. This is generally recognized as the character of concrete. Thus, it is not applicable to make honeycomb structures, from concrete. The honeycomb structure is comprised of concrete segments making a polygon. For example, after the concrete honeycomb is constructed, then the sides are bent, a partial shearing stress is generated at each segment part. This composes the ridges of the honeycomb structure. Then the segment, which is made from concrete, receives a dynamic force such as bending stress, some segments receive a tension force. This results in cracking if the segment is not reinforced with steel bars. Therefore, the concrete honeycomb without steel bars is weak, structurally. Thus, once the honeycomb structure is made from concrete has a crack, destruction of the honeycomb may occur.

In the field of civil engineering and architecture, there are significant needs for much lighter structural materials. Aluminum honeycomb structures are in use for such as wall panels, however, aluminum alone is not strong enough. On the other hand, duralumin, which is in use in the aircraft field, is too expensive to use widely. Also, the honeycomb structure which is only made from metal has a small damping coefficient. This small damping coefficient may result in structural problems. For the aircraft, wing section, a small damping coefficient is not a matter to consider. However, for building or civil engineering and infrastructure, if the damping coefficient is too small, in the case of earthquakes, vibration becomes an important issue.

Concrete is less expensive and stronger for compression forces than steel is, but needs less tension than steel to crack. There is reinforced concrete, which utilizes steel's tension strength and concrete's compression strength. However, this synergistic effect is unevenly distributed in the material and it's area is limited. Furthermore, if concrete and steel are applied to make a honeycomb structure, the structure is too heavy. Thus, it cannot be used for the aircraft which usually requires light material.

A honeycomb structure is a considerably effective material to produce little weight without sacrificing it's structural strength. However, it has not been utilized in the civil engineering and architectural fields, because it has been difficult to manufacture industrially and technologically. Even if the concrete honeycomb structure is made from the cement with formwork, the structure has not enough expected strength. It is then easier to break than lighten in weight. Also the cost of manufacturing will go up.

Generally, in the case of manufacturing the honeycomb structure which has the typical complex cell structure, the plate is first pressed into a half-hexagonal cross section, then it is shaped like a wave shape. Next, these two plates are put one upon the other. These plates are adhered to each other. Then the honeycomb structure is utilized as it is empty. An empty structure is lighter than a filled structure. This system is used in aircrafts. Also, when the honeycomb structure is used for an automobile's floor, it is hollow and empty. Therefore, if part of the structure is broken, the uneven loading force is increased by this deformation. This may result in sudden destruction of the structure.

After the honeycomb structure is formed out of metal, it is difficult to fill specific parts of the structure using the current technology. Therefore, it is difficult to make the honeycomb structure using both concrete and steel efficiently and economically. The combination of steel and concrete is the ideal complex material, but production is difficult. Up to this point no one has come up with a realistic process for making a concrete and steel honeycomb structure. This is because there exists the idea that the honeycomb must be made by bending plate materials.

The honeycomb structure's use is limited in civil engineering, the architectural field, and the automobile and car field. The application of aluminum or partial paperphenol material is also very limited.

There are projects currently underway with the goal of constructing skyscrapers and long bridges. The bigger the structure, the more important it is to utilize light structural materials. As is the case with automobiles, a lighter car generally makes a more fuel efficient car. the chassis, roof, floor, and body of the automobile need to be as strong, light, and durable as possible to create a safe and efficient car.

Generally, concrete is strong against compressive forces, and can be treated as a liquid material until it coagulates. Thus, the concrete is easy to form into any shape. However, it is difficult to make a honeycomb structure because of it's complicated procedure. Therefore, concrete is not applicable when making a honeycomb structure.

However, concrete has excellent qualities such as dynamic and material strength, that must be utilized when constructing a honeycomb structure.

However, a complex material consisting of concrete and steel bars has superior dynamic strength against both compressive and tension forces. However, it has been difficult to make it light. Thus, it has not been used as the structural material of machinery in areas such as the automobile and car industry. Also, because of it's heavy weight, an industrial application has been limited to th civil engineering and architectural area. There has never been any idea of utilizing a concrete and steel complex material for the structural material of machinery in the areas of the automobile and car industry. Because many people believe concrete is too heavy to utilize in the automobile or car, there has not been any available technology to make a honeycomb structure using, concrete and steel. To build a ship, usually a steel plate material has been used. And now, double hull technology has been developed to prevent oil leaks when the ships collide. However, when the ship is flooded by water, because the steel is so heavy, the ship will sink.

The objectives of the invention are to obtain a complex cell structured material which has the characteristics of being a tough and light material. Being economical in the production of general structural materials concerning architecture, civil engineering, machinery structure, automobiles, ships, cars, aircrafts, spaceships, space stations, submarines, and obtaining a simple process by which the material is manufactured are the key issues.

DISCLOSURE OF THE INVENTION

In order to achieve the aforementioned objectives, a new structure needs to be developed. This new structure is composed of three main parts which are the maintained spatial surface, the complex cell body which is comprised of light materials and boundary materials, and coagulant. The procedure for making this new complex cell structure is first that the complex cell body is produced by making high materials and boundary materials, then the complex cell body is distributed and bonded on the maintained spatial surface. Finally, the space between each complex cell body and the maintained spatial surface is filled with the coagulant. This produces a complex cell structure either partially filled or completely filled with coagulant, depending on the desired outcome.

Each of the elements which comprises this invention are explained as follows. First of all, the maintained spatial surface is explained. The maintained spatial surface maintains a plane or curved surface and has the ability to be distributed and bonded to the complex cell body on it. Therefore, the maintained spatial surface might be made from either a rigid body such as metal, metal mesh, a dense molecular plastic material which can be bent easily, a carbon fiber sheet, or a sheet material which can bent. Also, a metal net or fibrous sheet can be used. Any type of sheet material can be utilized no matter what kind it is, as long as it can be distributed/bonded. But, it's tension strength must be considered. It is better for it to use a more rigid material. Rigid materials such as a thin steel plate, iron plate, tin plate, high tensile steel, ultra high tensile steel or flexible sheet materials such as plastic sheets, vinyl sheets, fibrous sheets, carbon fiber sheets, flexible materials, and glass fiber sheets can be used. The thickness, shape or size of the maintained spatial surface can be determined based on the purpose of the structure, design strength or structural design, and it is not restricted by these elements. But generally, it is easily recognized that steel is better when used as a rigid body. This is because steel is an economical material and has dynamic strength when used with concrete. Thus, steel can be the ideal partner with concrete to become complex cell structure.

Now, the complex cell body is explained. The complex cell body is made from a synthetic resin such as plastic, foam resin such as urethane foam, styrene foam, bags which are filled with a high molecular material such as a particle board made from natural wood or gas such as air. Then, the complex cell is made with a strong tensile material as a boundary substance which contacts at least one of the planes of the light material. As a boundary material, the rigid, thin plate such as an iron plate, tin plate, engineering plastic sheet, which has a stronger tolerance against tensile force, on a flexible material such as a carbon fiber sheet is used. Also, the bag, which is made from aluminum foil or high molecular plastic, is filled with gas and can be utilized. At first, complex cell bodies are adequately distributed on the one side or both sides of the each maintained spatial surface which maintains the shape of the plane, or the inner space which is formed between the maintained spatial surface. When the complex cell body is distributed, it can be fixed on the maintained spatial surface.

The shape of the complex cell body can be any shape such as a rectangle, triangle or sphere. However, a hexagonal shape is the best. Especially, in the case of when a hexagonal shape is adopted, the structure can be a honeycomb structure. In such cases, in order to form a homogeneous structure, the same hexagonal shape is recommended. The size of the complex cell body can be from few centimeters to 20–30 centimeters, according to the environment and requirement, it can exceed 1 meter.

Second, the maintained spatial surface, which is made of many complex cell bodies, is prepared to apply to use for the structure of a floor or a pillar. More details of how to make the maintained spatial surface is that fit is attached and layered or rounded to form a cylinder. Then, these are further overlaid to form annual rings or are crossed to form a grid pattern. It can be put in the steel pipe, or it can be sandwiched between steel plates.

Third, the coagulant is poured and it fills the space which is formed between the complex cell bodies which are distributed and bonded on the surface of the maintained spatial surface. The coagulant can be either concrete, cement, mortar or plaster (in this invention, coagulant includes these materials). The coagulant is poured into the open space, then it coagulates later. In case of filling large spaces, usually cement or concrete is used because of it's economical advantages. However, in case of when precise filling is necessary, high liquidity concrete or cement milk can be used, and one can expect better pouring/filling results.

Then, the complex cell bodies, which are distributed/bonded onto the maintained spatial surface, only touch the incoming coagulant. Thus, this coagulant cannot enter into the cell structure. As a result, a complex cell structure is formed as a cell structure which is composed of lightened material, and the light cell structures are distributed in keeping with the gaps. Then, this makes the total complex cell structure. As a whole, it forms a homogeneous cell structure, and it becomes significantly lighter.

By the aforementioned method, the complex cell structure, which comprises many complex cell bodies, and is naturally formed by the coagulation. In other words, the frame's area has increased the structure's dynamic strength.

Therefore, most of the dynamic strength is at the point of the arm section of the complex cell structure, where the coagulation has taken place. Thus, if the arm section is made from coagulant, it is easy to crack, especially because concrete is weak against tensile forces. Therefore, it is difficult to produce a structure with optimal strength and resistance.

This is the reason for presenting a new method with metal such as steel or sheet materials made from carbon fiber, which is strong against tensile forces, that covers the arm section as reinforcement. Then, this combination becomes a strong material as a complex cell structure. In order to further understand this; consider an example of concrete filled steel column. The brim of each arm is sandwiched by the complex cell body, which is made from the material which has strength against tensile forces such as metal. This is because the functioning forces are either compressive or tensile at the edge of each complex cell body. Thus, the inner spaces between the complex cell body is not only filled with the coagulant, but also with the material which is strong against tensile forces such as metal or carbon fiber. This becomes the complex cell structure. This composition is a much better structure from dynamic point of view.

The production methods for the arm section of the complex cell structure are as follows. There are three major methods for production. The first method is to prepare a cylindrical object which is made from resin or a high molecular substance. Then, cover the surface area with metal. Generally, a hexagonal cell shape is selected because it is dynamically more stable and is sturdy against outside forces. However, any shape can be selected: cylinders, or polygon columns. Thus, the inside of the complex column is filled with a material to make the structure lighter and the brim of each cell is made of either metal or steel. The next step is to cut the complex column. When it is cut into round slices, many complex cell bodies are obtained, and each piece has at least one metal plane. The method for cutting involves a lathe, a water-jet cutter, or a general cutter can be used. However, less displacement and less deterioration provides for a more economical and quicker method. Although, any method can be used.

The second method is as follows. A light foam material such as urethane foam is put inside the tube, cylinder/polygon column, which is usually made from steel or carbon fiber. Then the foam material is foamed inside the container. The plane of the tube, cylinder/polygon column container is not necessary non-porous, it can be porous. In addition, a net or a mesh tube, cylinder or polygon column may be adequate in size of pore. Each pores can be placed regularly. This produces a complex tube, cylinder or polygon column and is cut into round slices in the same manner as mentioned above. Finally, there are many cell bodies which are wrapped by the metal material.

The third method, in contrast to the second method, utilizes a foaming agent which is already foamed then inserted into the tube like, cylindrical or polygon column. This column has been foamed, also, in advance. The foamed substance is shaped to fit the pre-molded column. Once the column is filled, it can be sliced and cut to make individual cell bodies. An adhesive is then spread on the out side of the prepared light material. Then, all the prepared light materials is inserted into the column to be cemented. Also, this can be done by inserting the foaming agent into the empty space of the column, and it fills the open space with the light material.

The complex cell bodies, which are produced by the methods explained previously, are distributed and bonded on the maintained spatial surface. It is better that the complex cell bodies be distributed often and evenly to obtain maximum dynamic toughness. When the complex cell bodies are distributed and fixed on the maintained spatial surface, they are then laminated, rolled, or overlaid in concentric circles, to make the basic structure. Another way is that at first, the surface of the maintained spatial surface is bent to fit the original design of the complex cell structure, then the complex cell bodies, which were previously arranged to have same curve as the designed surface, are distributed and bonded onto it. The method of fixing/cementing the complex cell bodies on the surface of the maintained spatial surface is done by using regular adhesive. Also, in order to obtain maximum strength for dynamic toughness, the complex cell bodies are regularly distributed and fixed on the maintained spatial surface. However, welding or mechanical fixing using screws, bolts and nuts can be used as necessary.

The compressing processes or procedures are now explained. First, a plastic film is prepared and is put on the flat shape maintained spatial surface and is bonded. Then, after the foaming agent is distributed grid like manner, it is sandwiched by the complex plates. After those plates are bonded, the foaming agent is foamed. In this procedure, it does not really a matter whether the foaming process is first or the sandwiching process is first. Thus, the flat plate type complex cell structure which contains many complex cell bodies is produced. As it is produced by such a procedure, the flat plate type complex cell structure can be used as it is. If it is necessary, the flat plate type complex cell structure is cut in half with two grids remaining. Then, many bag type complex cell bodies are formed. Also, the flat plate type complex cell structure can be treated as a basic raw material in the production phase.

Next, the inner space between each surface of the maintained spatial surface and the many complex cell bodies is filled with coagulant. Each complex cell body is fully or partially covered by the metal layer. Then, the inner space is filled with coagulant. Therefore, the area around the metal layer becomes the arnm as the complex material is made. While filling with coagulant, it can be filled not only from above as it has been done in between the steel sheets, but also from the side, continuously. The complex cell bodies are not penetrated with coagulant. As a result, the bodies take up the space that are lightened. In this procedure, if it is necessary a notch or spacer can be installed on the maintained spatial surface to promote and expedite pouring/filling. High liquidity concrete such as high performance concrete can be used to fill up to every space and corner. Therefore, when the complex cell body is filled with the light material, automatically the material is excluded from existing space. It fills up the space between the steel material or between the carbon fiber sheets.

Moreover, such complex cell structures, which are produced by the above method, are set in the square or cylindrical rigid tubes. Then, the empty space between the structure and the rigid tube is filled with coagulant. This complex structure can become a stronger, and tougher structure. In this case, steel is used. However, any type, any shape or any kind of material can be utilized. For example, even reinforced plastic or fiberglass reinforced glass ,FRP, can be used as long as it has strength against tensile forces.

There are elements in this invention requiring attention. This includes the complex cell structure, the maintained spatial surface, the complex cell body which is comprised of the light material and rigid thin plate, and the coagulant which fills the space between these bodies and the cells. Every function of these elements is explained in order. First, is the maintained spatial surface. What the maintained spatial surface does is it distributes/positions the complex cell bodies properly and attaches the bodies to the surface. This is the most important role in the complex cell structure.

The structure of the complex cell body is now explained. Basically, the body is comprised of light material and fills the inside of each cell. The brim section, which is the wall of the cell, provides the boundary for the light material. The light material obviously reduces the cell weight and occupying the space in the structure to exclude the incoming coagulant. Also, this material functions as a heat insulator and an acoustic barrier.

The brim section forms the frame of the complex cell body to reinforce the body. It maintains the dynamic strength against compressive forces. However, the inner space between the cells is filled with a coagulant such as concrete. The brim functions to create more tolerance against heavy loading forces combined with the sections at the proximity of the borders of the complex cell bodies.

Each complex cell body is attached or can be fixed on the maintained spatial surface. If necessary, they can be fixed with nuts and bolts. The maintained spatial surface functions as a foundation for distributing/attaching the complex cell bodies while keeping space between the bodies. Also, when steel plates or carbon fiber sheets are used as the material for the maintained spatial surface, the dynamic strength becomes greater.

The maintained spatial surface can be formed either with single layers or multiple layers. However, sandwiched structures with multiple layers are better to obtain greater strength for each maintained spatial surface. Thus, the maintained spatial surface becomes effectively and dynamically stronger.

Concerning the maintained spatial surface in multiple layers, there are several methods for production. The flat maintained spatial surface is layered, or it is rounded to make a spiral shape or an annular ring shape. With the methods, there is a strength against the tensile force, the structure becomes stronger as a whole.

After each complex cell body is distributed/bonded on the maintained spatial surface, the light material occupies the space in the structure and excludes the coagulant. The coagant fills the remaining space. The coagulant is then combined with the brim section and functions to produce a dynamic synergistic effect in the concrete filled tube column.

In case of inserting a liquid bag into each complex cell body, each inserted bag (liquid bag) functions to increase the dumping effect to the structure. When the structure is shaken, the liquid bag absorbs the vibration. This happens because the liquid bags start shaking when the vibration is transmitted to the bags. Then, the bags absorb the energy of the vibration. As a result, the inner hysteresis becomes higher, then the dumping rate becomes high.

A production method for complex cell bodies is explained as follows. First, the pillar like shaped material, which is made from light material, is prepared. In this case, if a hexagonal pillar is adopted, dynamic strength becomes higher. However, any shape pillar or cylinder can be used to meet the original objectives. Next, the pillar or cylinder is wrapped by the thin film or plate, which is made from metal. This pillar or cylinder is cut into round slices. These slices are the complex cell bodies which contain the light material inside. The frame is made of metal or the sheets. The method of cutting can be done by main two methods. One is a complete linear cross section, the other is a curved cut which matches the line of the rolled or rounded maintained spatial surface curve. The former is the case for when hexagonal shaped complex cell bodies are attached on a flat maintained spatial surface. The latter is the case for when the hexagonal shaped complex cell bodies are attached on a rolled or rounded type maintained spatial surface.

There is yet another method. First, the hollow metal tube or cylindrical vessel is prepared. Then, the foaming agent is put inside the vessel. It is then foamed. This is how to make the tube or cylinder, which is filled with the light material. Then, this light material filled vessel is cut into round slices to obtain each complex cell body, which is already described above.

Another option is to fill the metal frames with the foaming agent after the frame are cut. This also produces the complex cell bodies.

Also , this can be obtained by wrapping the aluminum or metal foil, and filling each section with gases. This forms an aluminum or metal bag. This procedures the same structure of complex cell bodies as explained above.

Then, the complex cell bodies are distributed and attached on the surface of the maintained spatial surface which is made from the material that has strength against the tensile forces. Because these bodies are fixed on the surface of the maintained spatial surface by a coagulant the first fixing on the maintained spatial surface can be temporary.

Thus, after the attachment of the complex cell bodies is completed on the maintained spatial surface, the coagulant is poured into the remaining space. Additionally, because inside of each complex cell body is made from the light material, the concrete cannot enter the space that is taken up by the body. The poured concrete goes into the remaining space between the complex cell bodies and between surface of the plane maintaining bodies.

The arm sections form each frame structure of the complex cell body. They are combined with a rigid plate such as steel and the coagulant to form each complex cell structure.

In this structure, the loading force is supported and shared by many complex cell bodies with the laminated structure. The arm section is consequently comprised of a complex structure combined rigid and coagulated material. Therefore, if the structure is loaded by the tensile forces, the metal section, which is usually strong to the tensile force is utilized. Against the compressive forces, the coagulant such as concrete section, which usually strong to the compressive force is utilized. By this synergistic function, the invented complex cell structure becomes significantly strong against any loading force.

A more detailed dynamic analysis of the complex cell structure is necessary. First of all, against the upper compressive forces, each complex cell body disperses the loading force, and each coagulant section dispenses the compressive forces. At the same time, each complex cell body tend to expand horizontally. In other words, when the compressive force acts on this structure at each complex cell body, the force is loaded to the frame section of the maintained spatial surface. Thus, each complex cell body tends to expand horizontally. But, the maintained spatial surface tends to shrink, expanding inside from the outside. As a result, for the maintained spatial surface, it functions against tensile forces, but the maintained spatial surface is made from a material such as steel, which usually strong against the tensile forces. Therefore, combining the high tolerance of compressive force from the coagulant such as concrete, the total strength of the structure becomes extremely tough and strong, synergistically as a whole.

On the other hand, in the case of using a non-rigid material, strong interaction is not expected. A small synergy effect can be expected to some extent from the combination of minimal rigidity and compressive tolerance of the coagulant Furthermore, the total weight of the structure is limited because a great deal of the space of the structure is taken up by the light material which is placed inside of the complex cell body. The only heavy parts are the portion of coagulant which have been filled in the remaining spaces of the structure as explained above. Therefore, the total weight of the structure is significantly lighter than that of a structure which is made from only concrete and steel.

Each complex cell body inside is filled with light material, so that significant deformation will not occur. Also, even if part of the arm section is deformed, the affect of the deformation is dissipated by the other cell structures. So a sudden collapse won't happen. Thus, this structure is totally different from the existing structures. It is much stronger, tougher and resistant.

In the case of plate type complex cell structures, the wall is light weight but has considerable high strength against loading. For example, the outside of both surface walls is made from this invention's complex cell structures, and inside wall is filled with a light material such as urethane foam.

The tube or plate type complex cell structures using the invention can produce stress inside the structure by using the fiber or steel bar. It is possible that pre-stressed and post-stressed structures can be created from this invention. Thus, the invention enables to make a much stronger complex cell structure.

THE BRIEF DESCRIPTION OF THE FIGURES

THE BEST EXPRESSION OF THE INVENTION

Figure 1:
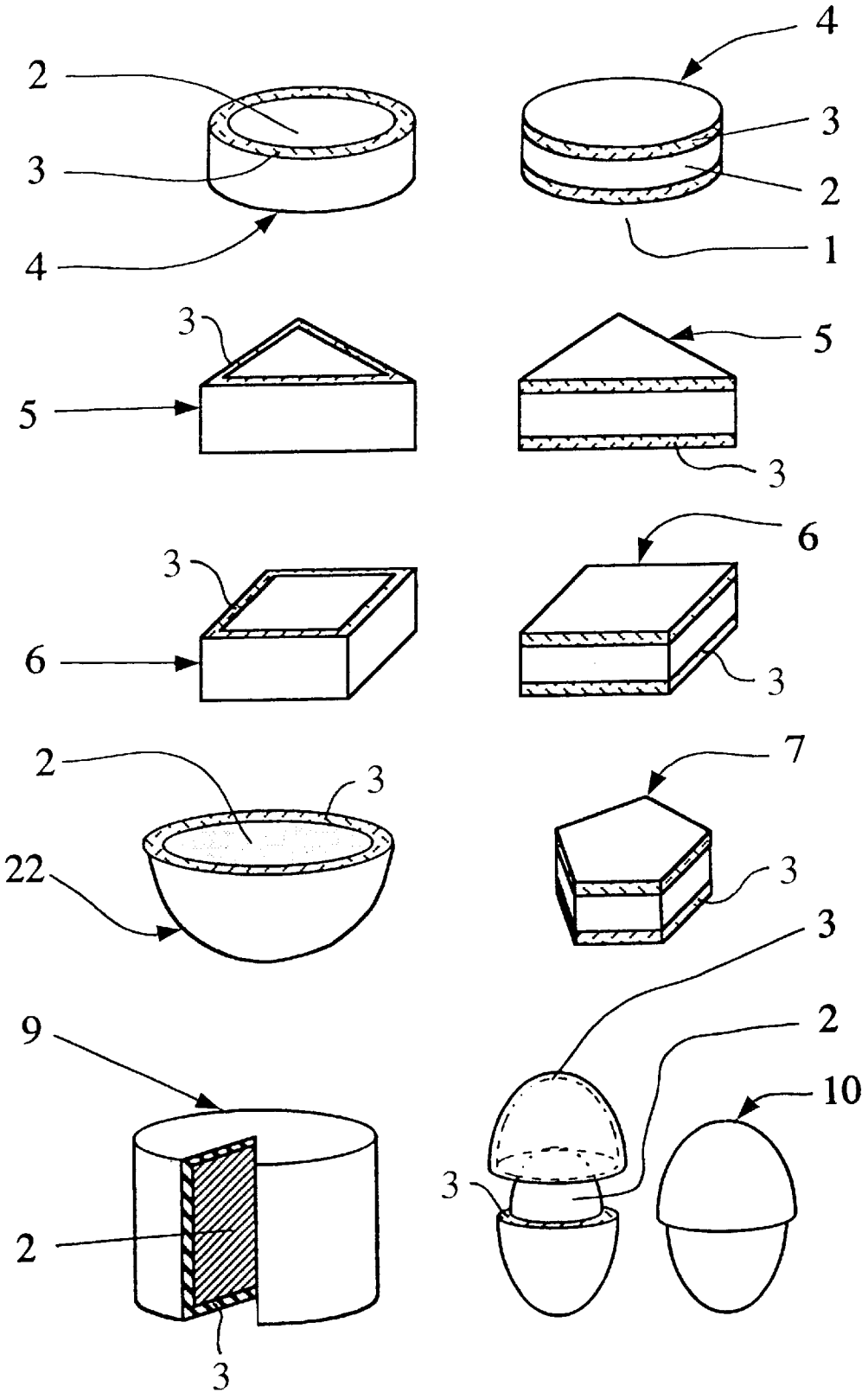
FIG. 1 shows a variety of the complex cell bodies.

The following are examples of the invention, each example is explained in detail. First of all, FIG. 1 shows the strabismal figure of a variety of the complex cell bodies. A complex cell body 1 is comprised of the light material 2 which is made from urethane foam. Brim section 3, is made from a thin steel plate, and is wrapped around the light material 2. In this invention, as for the shape of the complex cell body, any shape can be used. However, in this figure, only typical shapes are presented such as a cylindrical tube complex cell body 4, with brim section 3 (having a cylindrical cross section) along the circumference, or circular shaped brim sections on the top and bottom, respectively, a triangle complex cell body 5, with a brim section 3 (having a triangular cross section) around the perimeter or triangular shaped brim sections on the top and bottom, respectively, a rectangular complex cell body 6, with a brim section 3 (having a rectangular cross section) around the perimeter or rectangular shaped brim sections on the top and bottom, respectively, a pentagonal complex cell body 7, with a brim section 3 (having a pentagonal cross section) on the top and bottom. Also shown is a can type complex cell body 9, which contains a light material 2, a capsule type complex cell body 10, and half spherical shape complex cell body 22.

Figure 2:
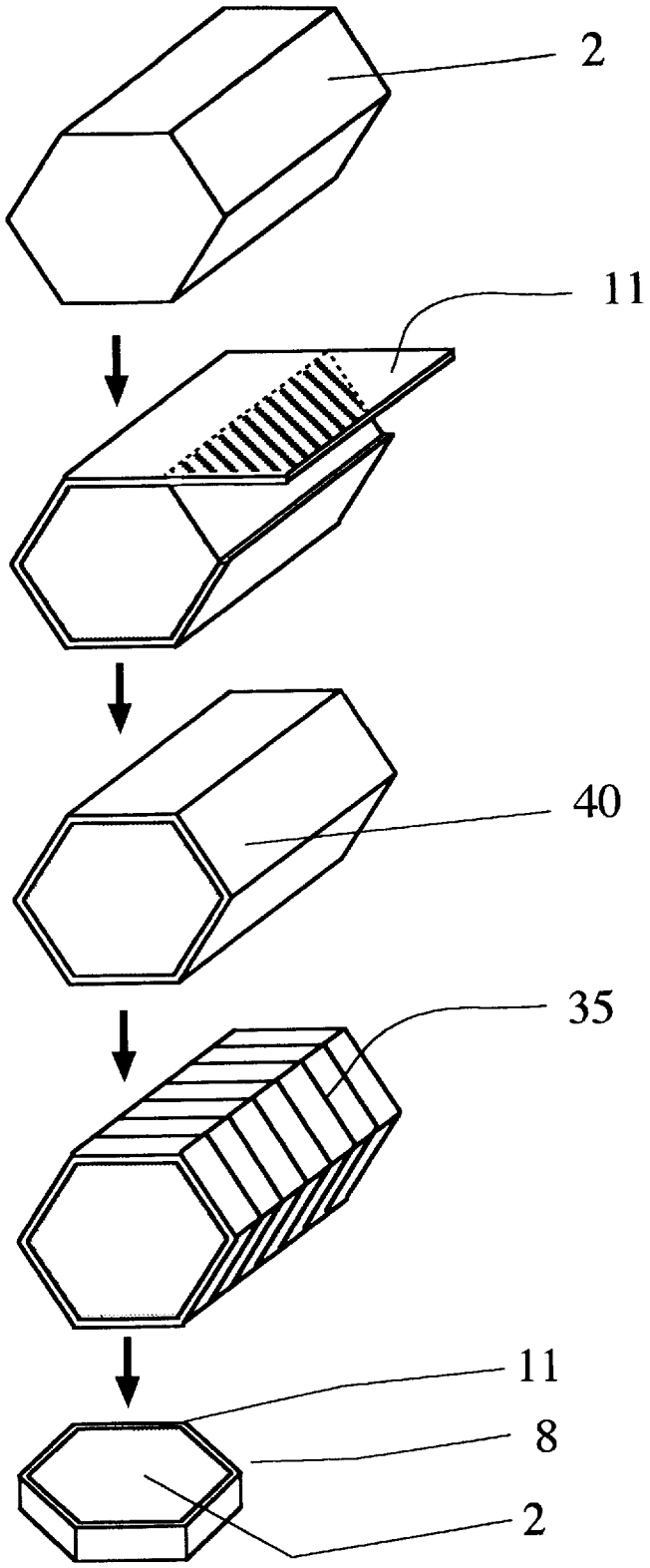
FIG. 2 shows the strabismal figures of an example of the procedure to produce the hexagonal complex cell body.

FIG. 2 shows the example of the procedure to produce the hexagonal complex cell body 8. First, the light material, which is already shaped hexagonally and is made from urethane foam, is prepared. The light material is then wrapped by the tin plate 11 along longitudinal direction of the tube and adhered. That is how to make the hexagonal tube complex cell body 40 which is comprised of the light material 2 and the brim made from thin layer of tin plate 11. Next, this hexagonal tube 40 is cut to form slices by the lathe cutter to obtain many complex cell bodies 8.

Figure 3:
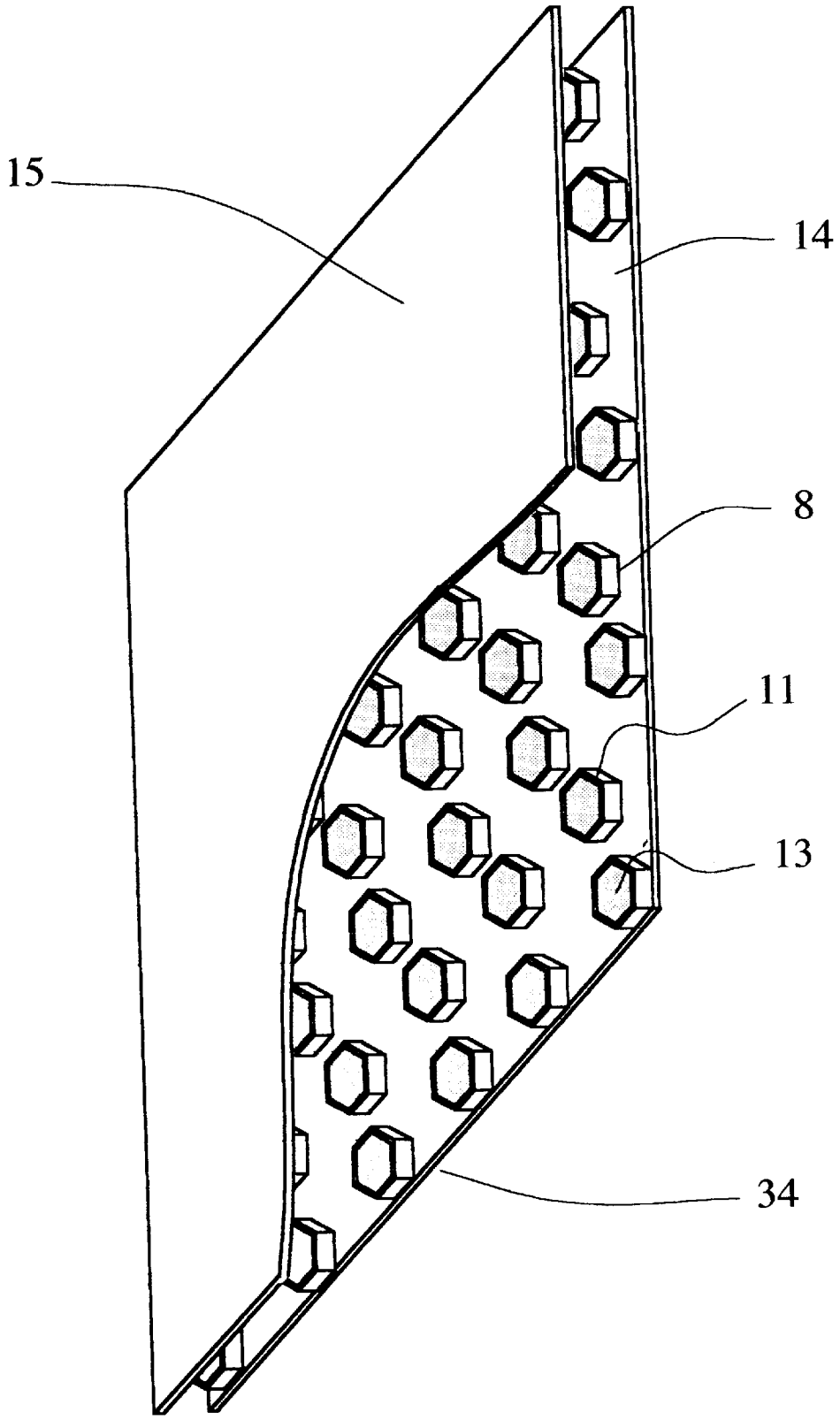
FIG. 3 shows the strabismal figure of plate type complex cell structure.

FIG. 3 shows the procedure to make the plate type basic complex cell structure 34. First, the hexagonal complex cell bodies 8 are distributed and bonded by the adhesive on the plate type maintained spatial surface 14. Then, the upper cover 15 is put in place. This happens is just before a coagulant, such as concrete, is poured. In the FIG. 3, part of closer cover 15 is cut off so as to see the inside. Each inner portion of the a complex cell body is made from urethane foam 13, and the brim is made from a thin steel layer 11.

Figure 4:
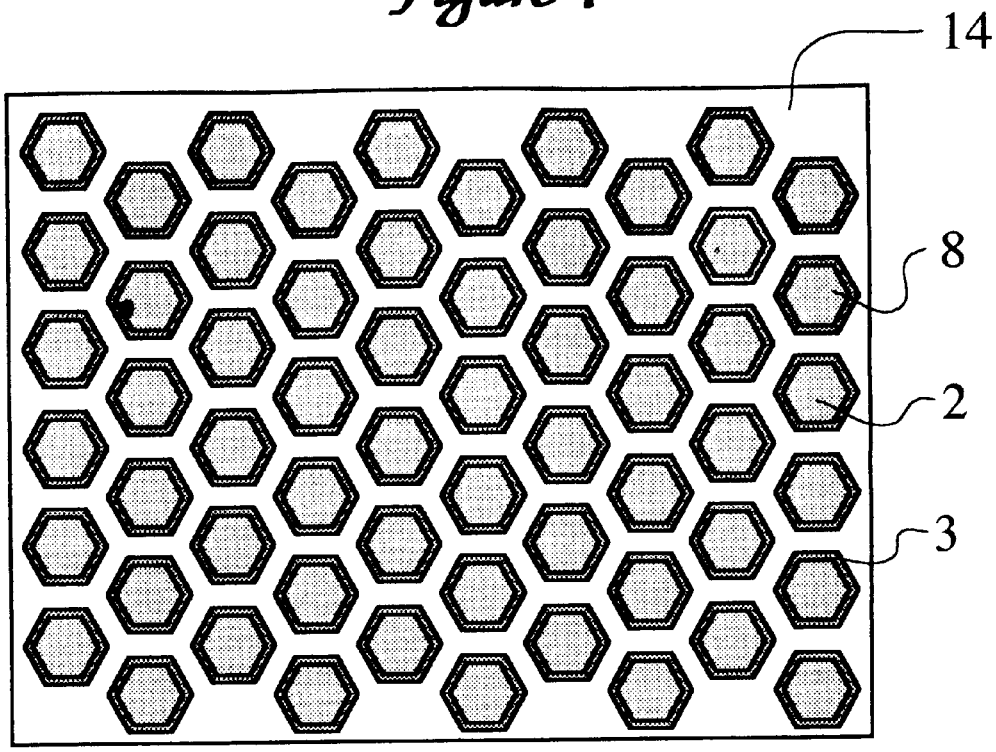
FIG. 4 shows the plane figure of an example of the distributed hexagonal complex cell structures.
Figure 5:
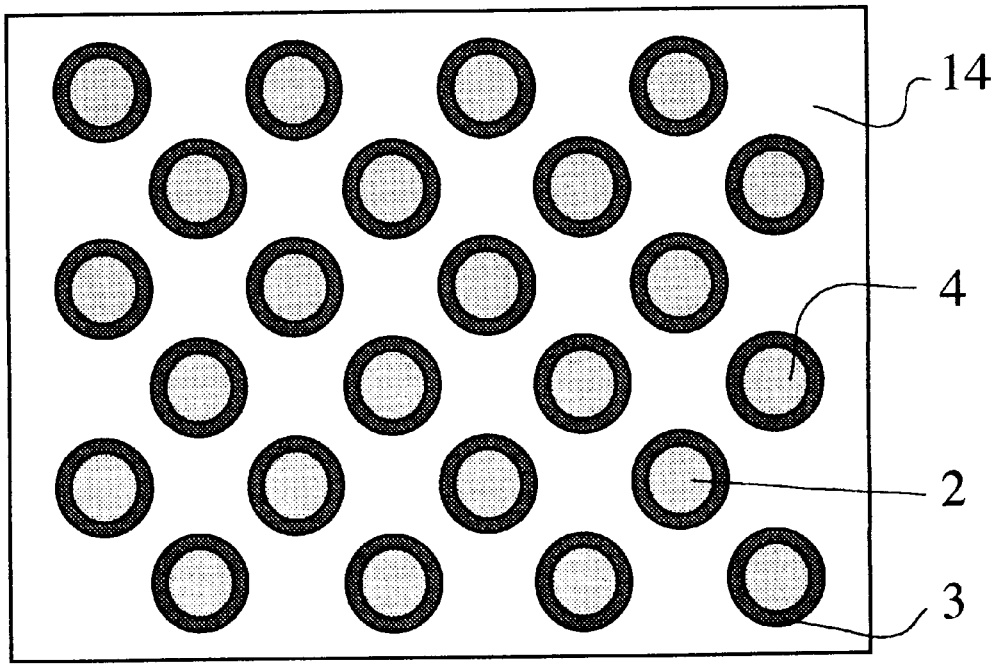
FIG. 5 shows the plane figure of an example of the distributed cylindrical complex cell bodies on the flat type maintained spatial surface.

FIG. 4 shows the plane figure of an example of the distributed hexagonal complex cell structure 8 on the flat type maintained spatial surface 14. And FIG. 5 shows the plane figure of an example of the distributed cylindrical complex cell body 4 on the flat type maintained spatial surface 14.

Figure 6:
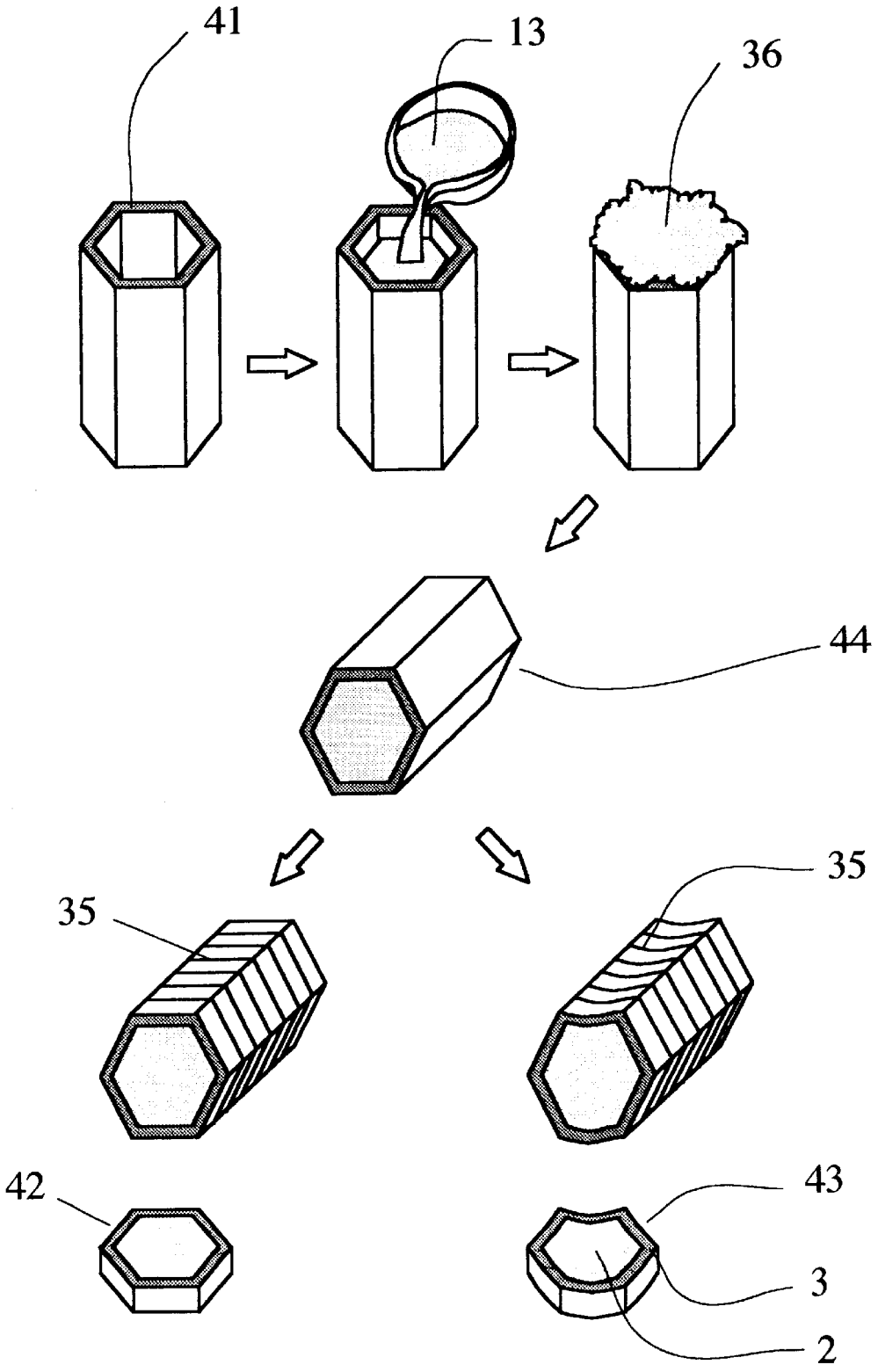
FIG. 6 shows the strabismal figure of an example of the procedure to produce the hexagonal complex cell bodies.

FIG. 6 shows the strabismal figure of an example of the procedure to produce both of the hexagonal complex cell bodies for the flat type 42 and the hexagonal complex cell body for the curved type 43. First the hollow steel hexagonal tube 41 is prepared, put an adequate amount of urethane foam resin 13 is put inside the tube 41, then the resin expands to fit the encasing. After this is formed, the complex cell bodies which are comprised of a thin steel brim 44 is cut to form round slices using a water-jet cutter. This potentially produce tow kinds of cell to fit either on a flat surface 42 or curved surface 43.

Figure 7:
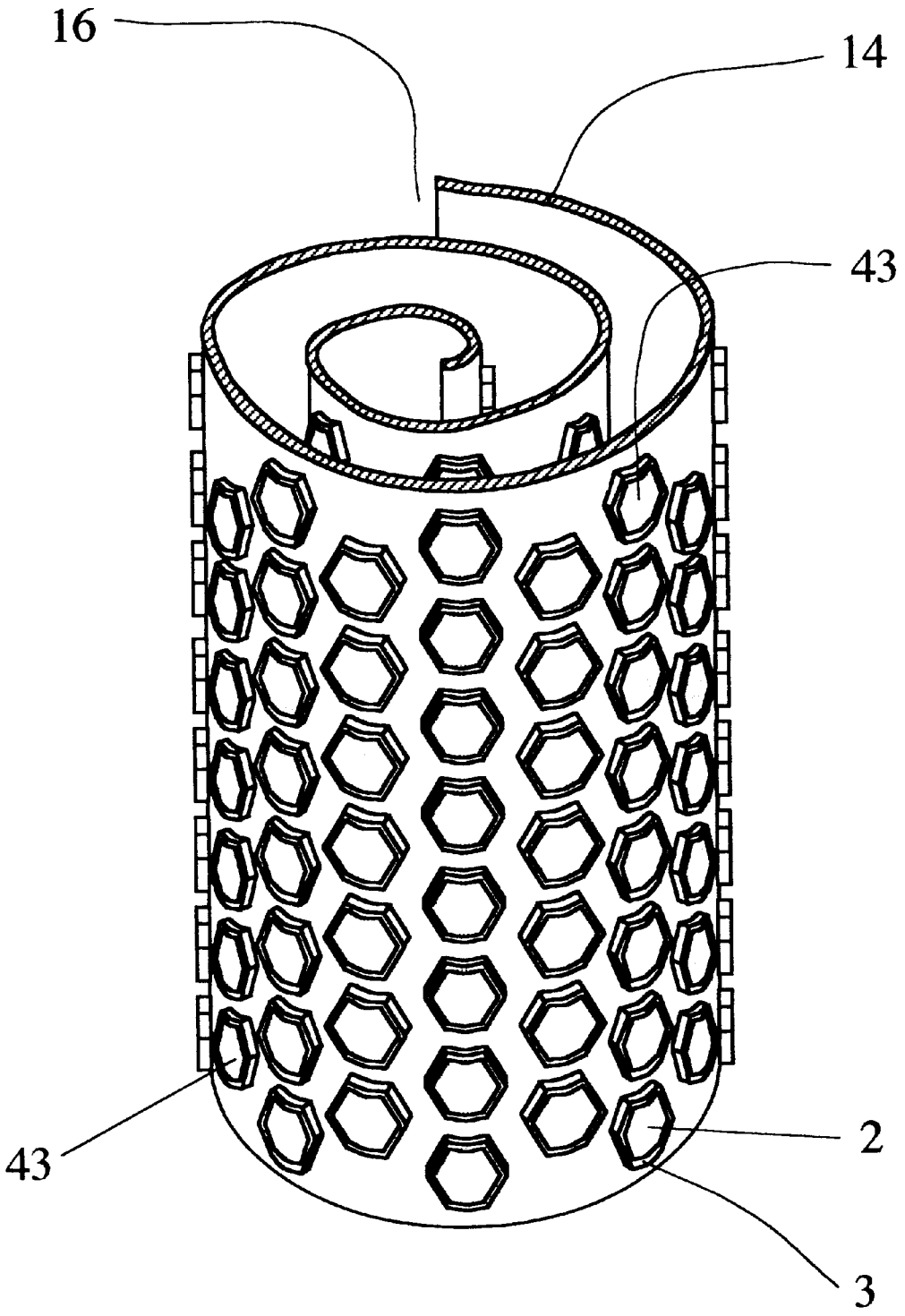
FIG. 7 shows the strabismal figure of the rolled type complex cell structure.

FIG. 7 shows the strabismal figure of a rolled type complex cell structure 16, just before the coagulant is poured. First, the necessary number of the hexagonal complex cell bodies for the curved type 43 are prepared. These complex cell bodies are distributed and bonded on the maintained spatial surface 14, it is then rolled to form a spiral shape.

Figure 8:
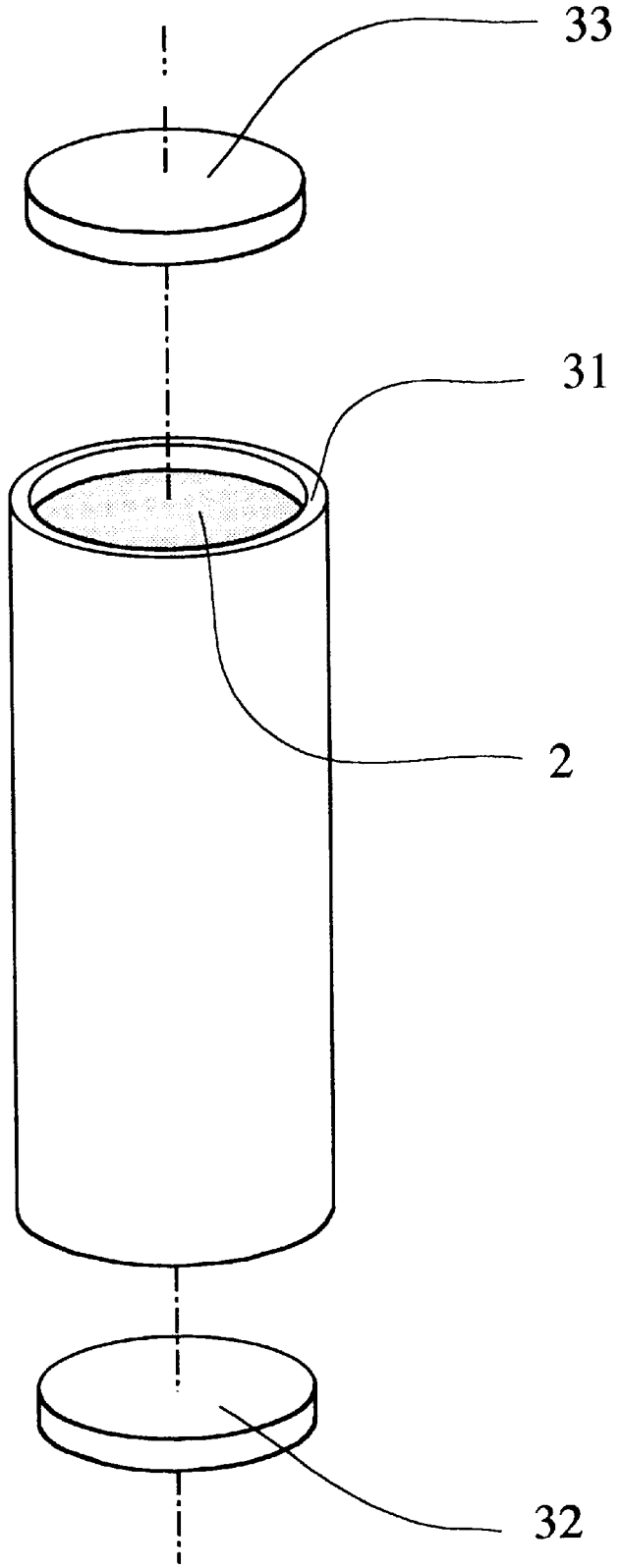
FIG. 8 shows the strabismal figure of an example of the procedure to produce the can type complex cell structure.

FIG. 8 shows the strabismal figure of an example of the procedure to produce the can type complex cell structure 9. First, a thin layered steel cylindrical can 31 is prepared, the foamed light material 2, which has already been formed and arranged to fit into the can, is also prepared. The material 2 is inserted into the can 31. After it is inserted, the upper steel plate cap 33 and the bottom 32 is set in place, sealed, and bonded.

Figure 9:
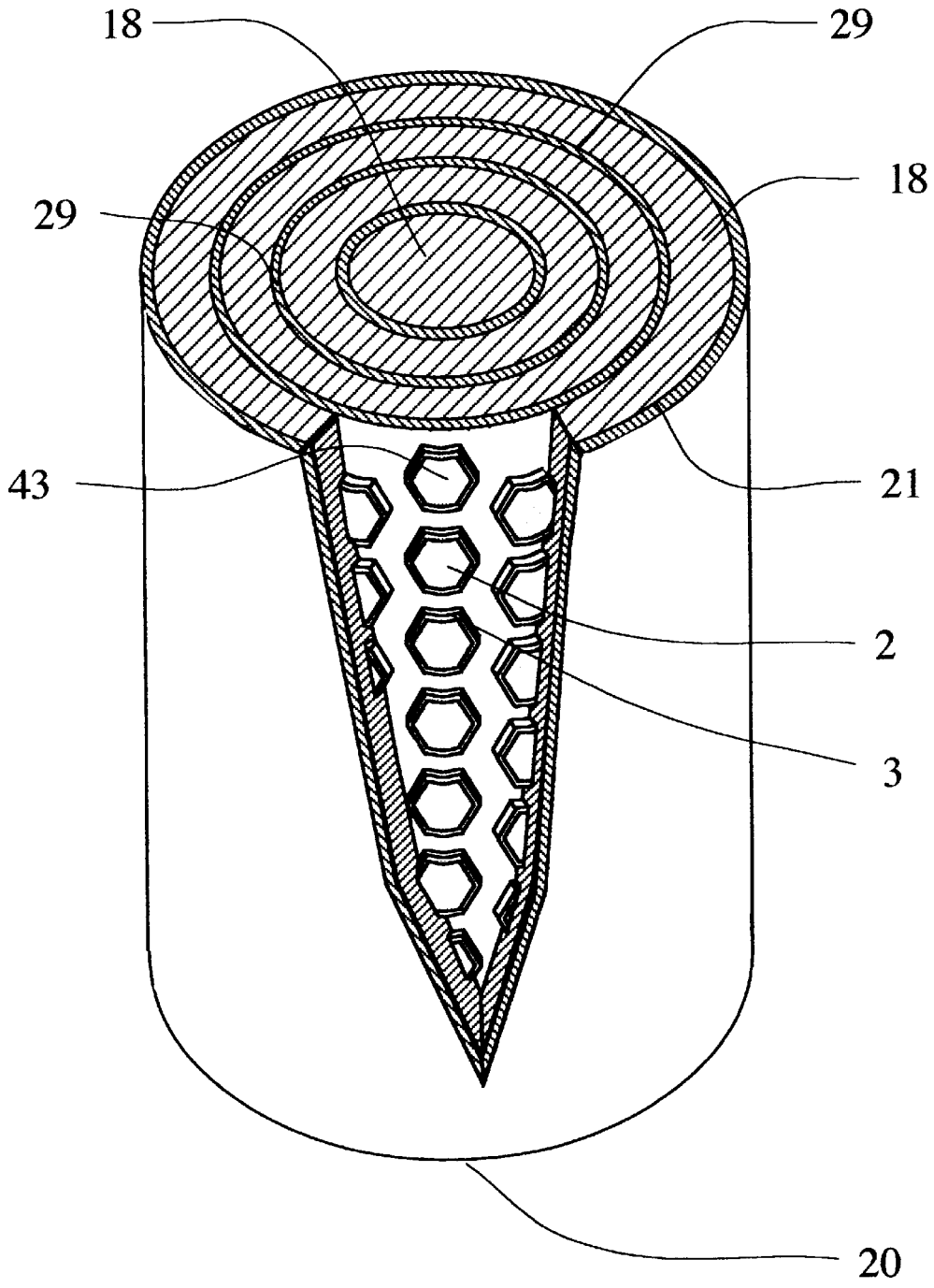
FIG. 9 shows the strabismal figure of the annual ring type complex cell structure.

FIG. 9 shows the strabismal cross section figure of the annual ring type complex cell structure 20. This structure is made as follows. The prepared annual ring shaped complex cell structure 20 is inserted into the steel cylindrical tube 21. After insertion is complete, the coagulant is poured. The structure is cut by a cross section. The figure shows the inside so as to see more details on the inside the structure. The following is the procedure for producing such cylindrical tube, annual rings in the complex cell structure. First, three of the cylindrical plane maintaining bodies 29 are prepared, each with different diameters. The complex cell body for the curved type 43 is already prepared and are distributed on the cylindrical plane maintaining bodies 29 keeping, with orderly gaps. They are then bonded onto the body using an adhesive. Then these complex cell bodies are attached to the tube which is put inside of another tube which is larger in diameter to obtain an annual ring like shape. Then, high liquidity concrete 18 fills the open spaces. After the concrete goes into every empty space between each cylindrical maintained spatial surface 29, the concrete then coagulates properly. Finally the annual ring shaped complex cell structure 20 is produced. In addition, the hexagonal complex cell bodies in use for the curved type maintained spatial surface 29 has been already cut to fit the curve of the maintained spatial surface.

Figure 10:
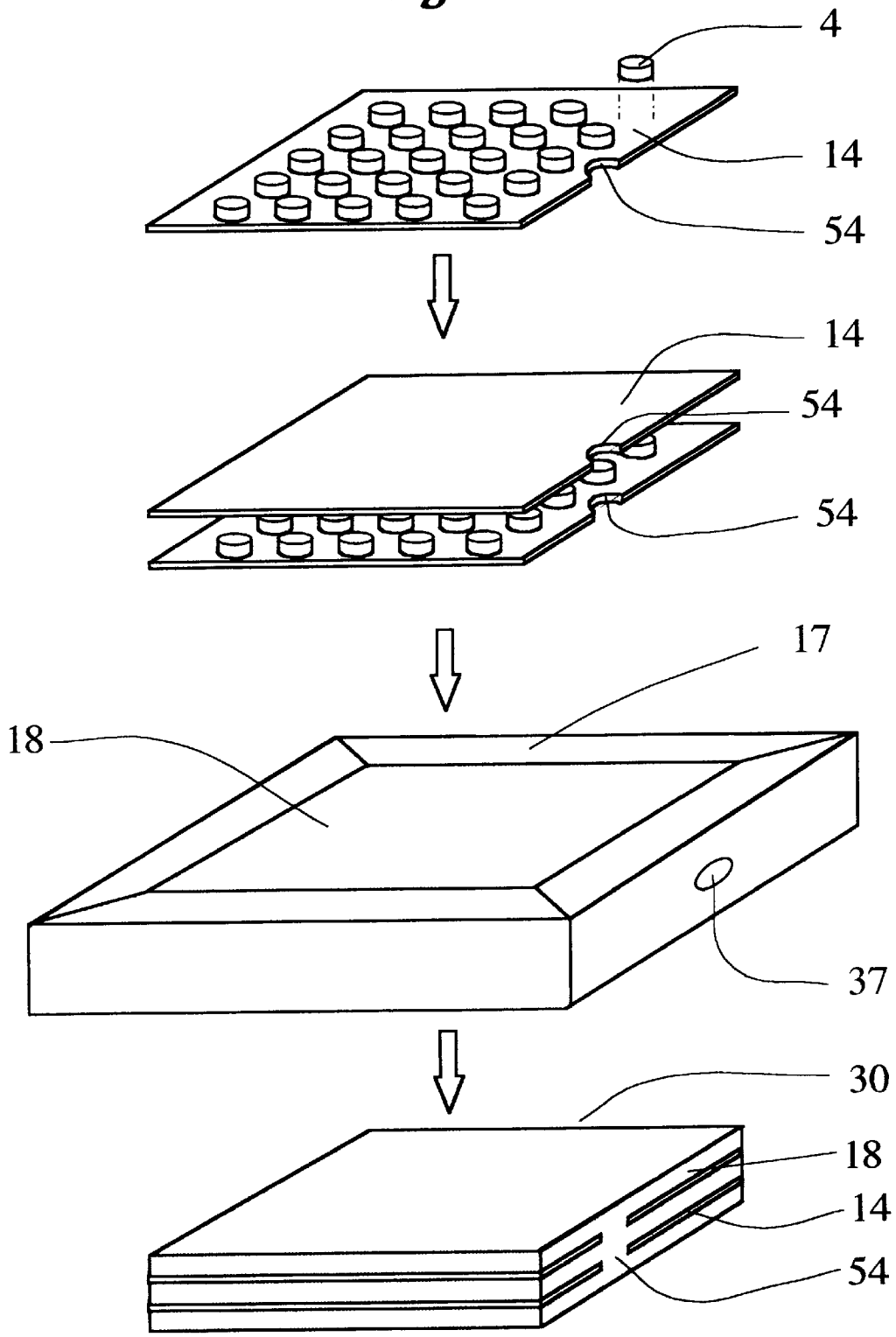
FIG. 10 shows the strabismal figure of an example of the procedure to produce the plate type complex cell structure.

FIG. 10 shows the strabismal figure of an example of the procedure to produce the plate type complex cell structure 30. First, the cylindrical complex cell bodies 4 are prepared. These bodies are then distributed and bonded on the flat type maintained spatial surface 14 in order. Next, the second maintained spatial surface is attached to the cylindrical complex cell bodies which is produced in same manner as stated above. It is then overlapped on the first plane 14. Then the overlapped structure is put in the formwork 17, and the high liquidity concrete 18 is filled from the mouth 37. Also, notch 54 is installed, therefore the filling process is completed perfectly. After the coagulation is finished, the formwork 17 is removed. Finally, the plate type complex cell structure 30 is produced.

Figure 11:
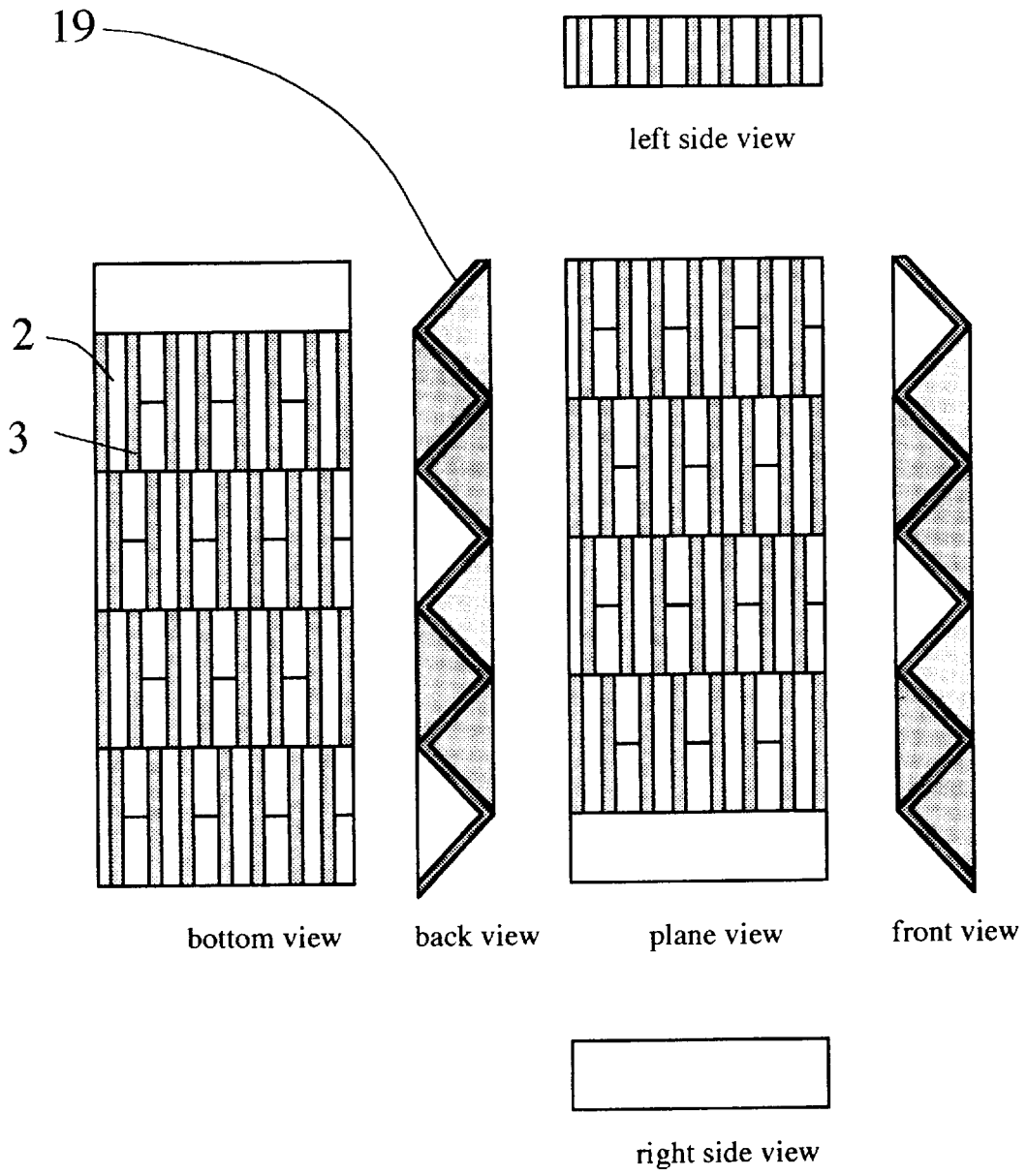
FIG. 11 shows the one example of the basic structure which is comprised of producing a wave plate for the maintained spatial surface and the complex cell bodies.
Figure 12:
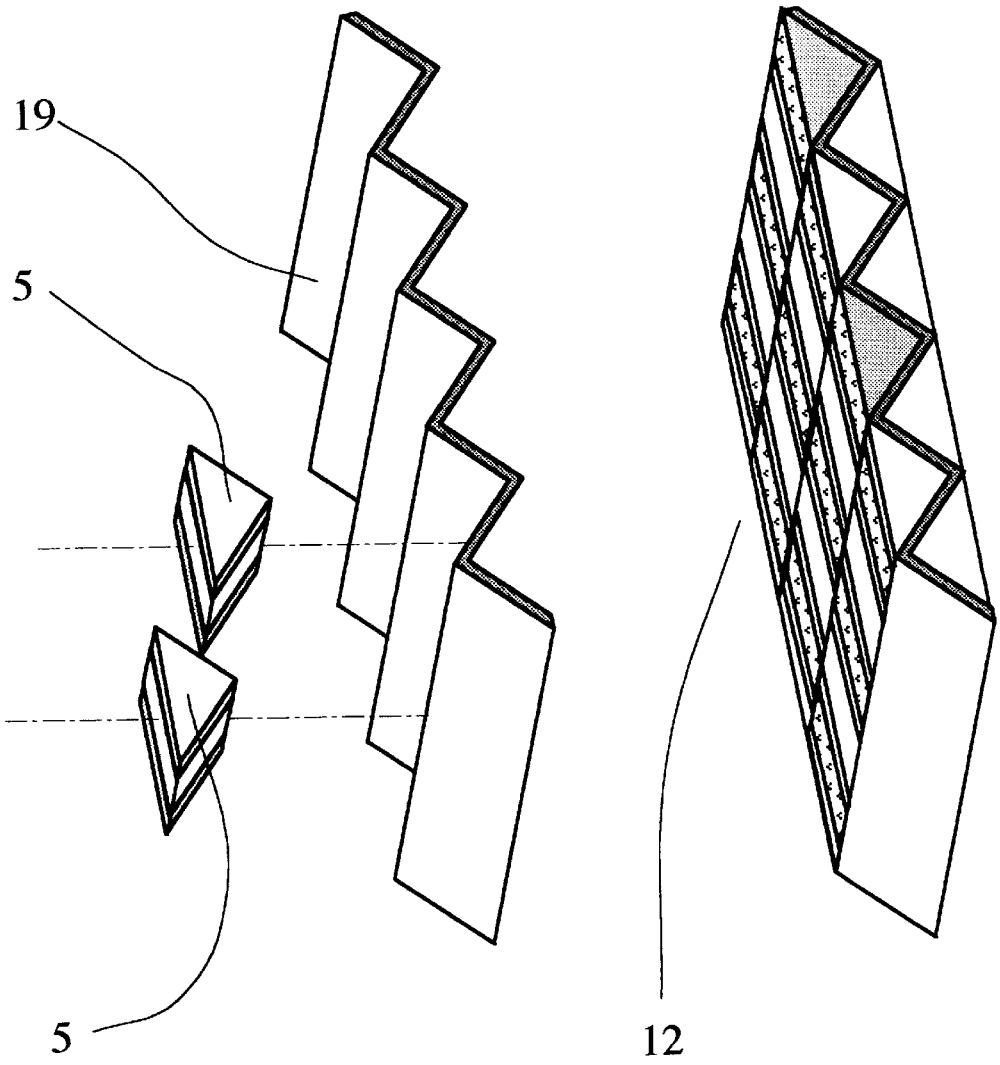
FIG. 12 shows the strabismal figure of an example of the basic structure.

FIG. 11 shows an example of the basic structure which is comprised of the wave plate for the maintained spatial surface 19 and on which the triangle type complex cell body 5 is distributed and bonded. This is an illustration of the structure before it is filled with coagulant. FIG. 11 shows the basic structure (in this invention, the basic structure means the combination of maintained spatial surface and the complex cell bodies) on a plane view, the front view, the bottom view, the back view, and the left view and the right view. The triangle complex cell bodies 5 are distributed alternately on the wave plate on the maintained spatial surface 19, the space between each cell is empty space. Further, the FIG. 12 shows the strabismal figure of an example of the basic structure 12, which contains the triangle type complex cell bodies 5 distributed/bonded onto the surface.

Figure 13:
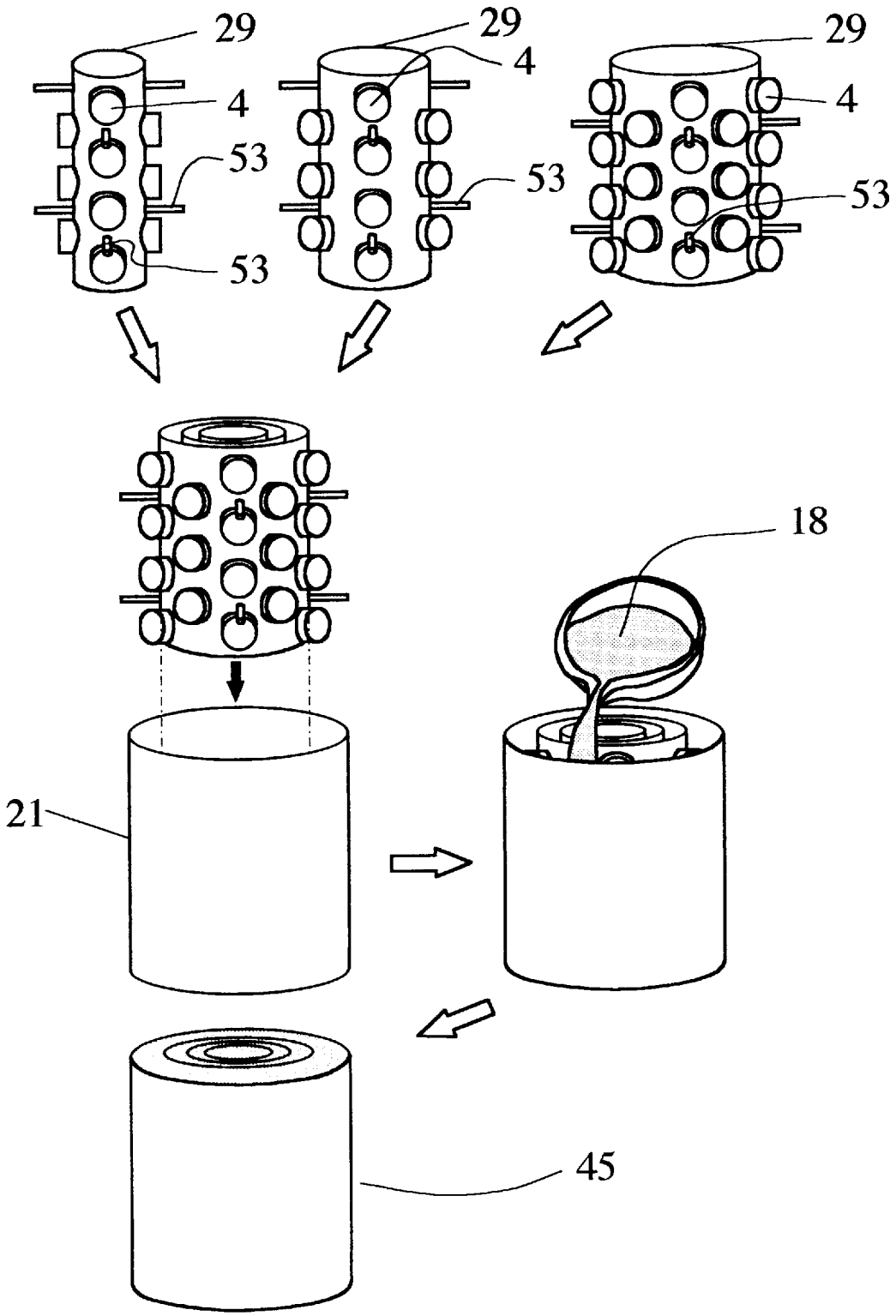
FIG. 13 shows the strabismal figure of an example of the procedure to produce the cylindrical tube type complex cell structure.

FIG. 13 shows the strabismal figure of an example of the procedure to produce the cylindrical tube type complex cell structure 45. First, several cylindrical tubes with varying diameters constitute the maintained spatial surface 29. On tubes the cylindrical complex cell bodies 4 are distributed and bonded, and prepared. In addition, the spacer 53 is installed to keep the distance between the tubes constant. The tubes are put inside the next larger tube and are then overlapped. Then, the basic structures are inserted into the steel cylindrical, tubular vessel 21. After the basic structure is built, the concrete 18 coagulant is poured from the upper inlet to fill the vessel. The concrete is then coagulated to obtain the cylindrical tube complex cell structure 45.

Figure 14:
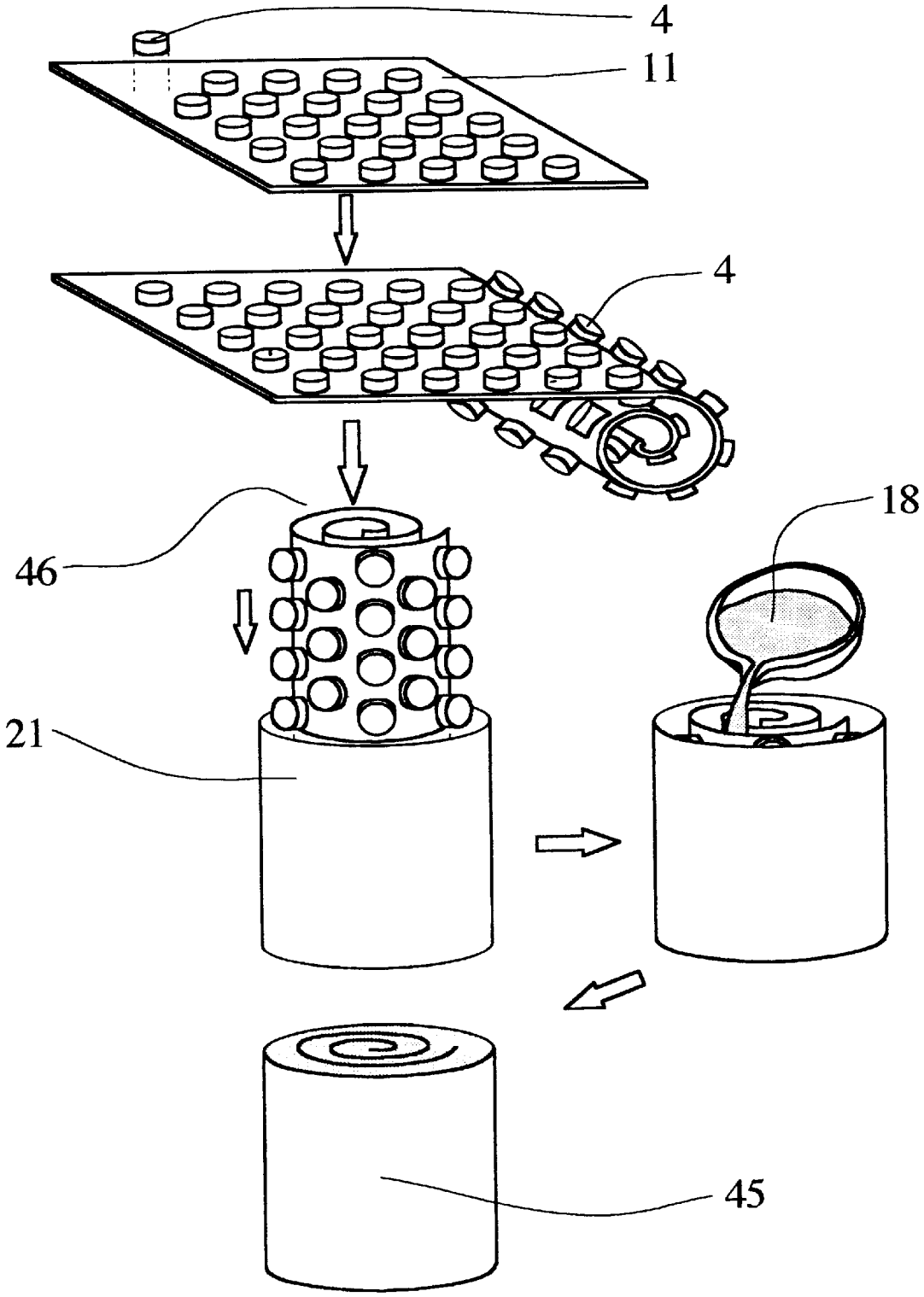
FIG. 14 shows the strabismal figure of an example of the procedure to produce the cylindrical tube type complex cell structure.

FIG. 14 shows the strabismal figure of an example of the procedure to produce the cylindrical tube complex cell structure 45 using a rolled version of the maintained spatial surface 46. First, the tin plate 11 is prepared, then the cylindrical complex cell bodies 4 are distributed and bonded on the maintained spatial surface. This flat basic structure is rolled by a rolling machine. Then, it is inserted into the steel, cylindrical tubular 21. Next, high liquidity concrete 18 is poured from the upper inlet After tube 21 is filled with concrete 18, the concrete coagulates to obtain the cylindrical tube complex cell structure 45.

Figure 15:
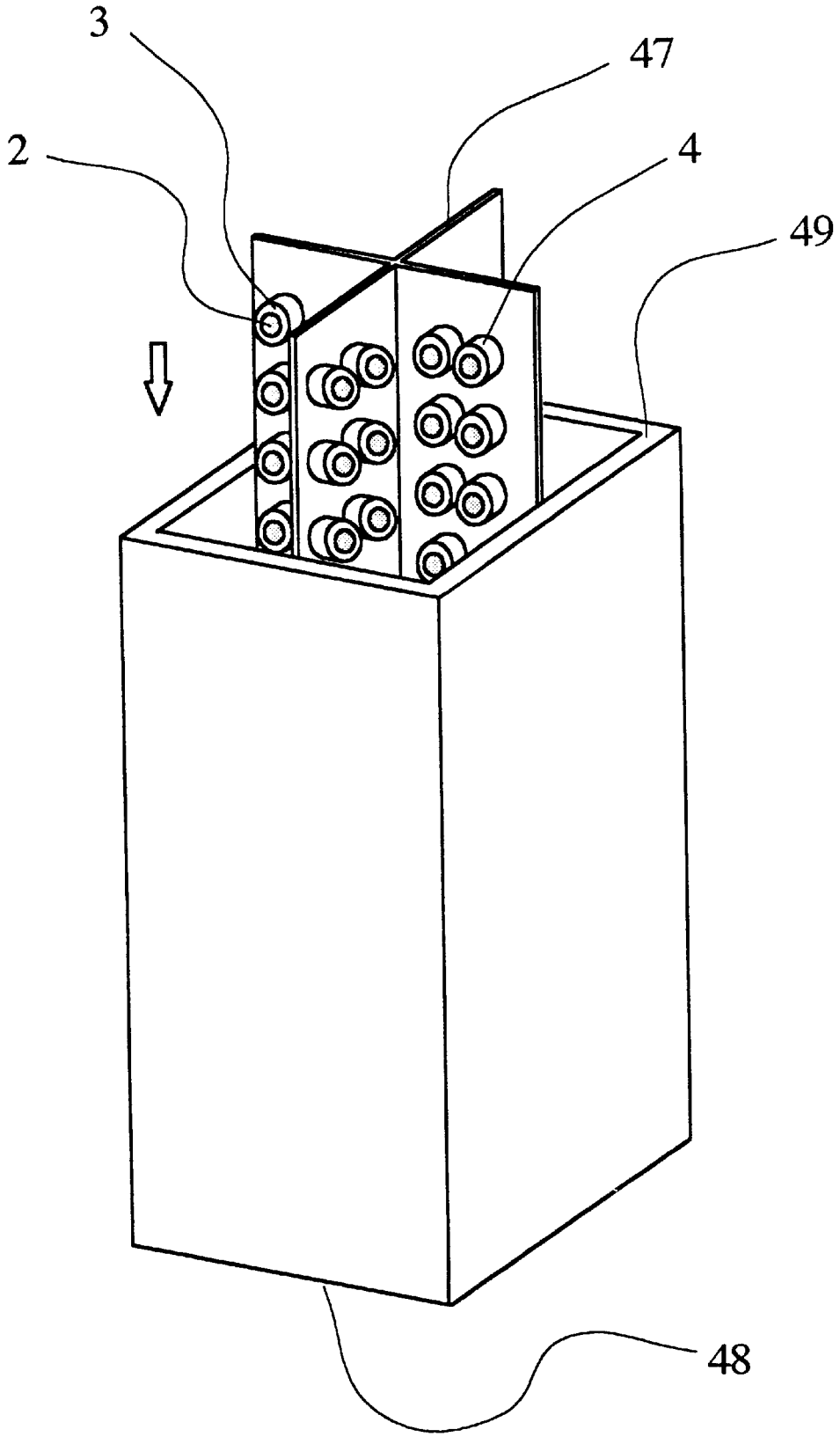
FIG. 15 shows the one example of the basic structure of square type tube complex cell structure.

FIG. 15 shows an example of the basic structure of the square tube complex cell structure 48 using the perpendicular crossing maintained spatial surface 47. The cylindrical complex cell bodies 4 are distributed and bonded on the perpendicular crossing maintained spatial surface 47. It is then set inside the steel square tube vessel 49.

Figure 16:
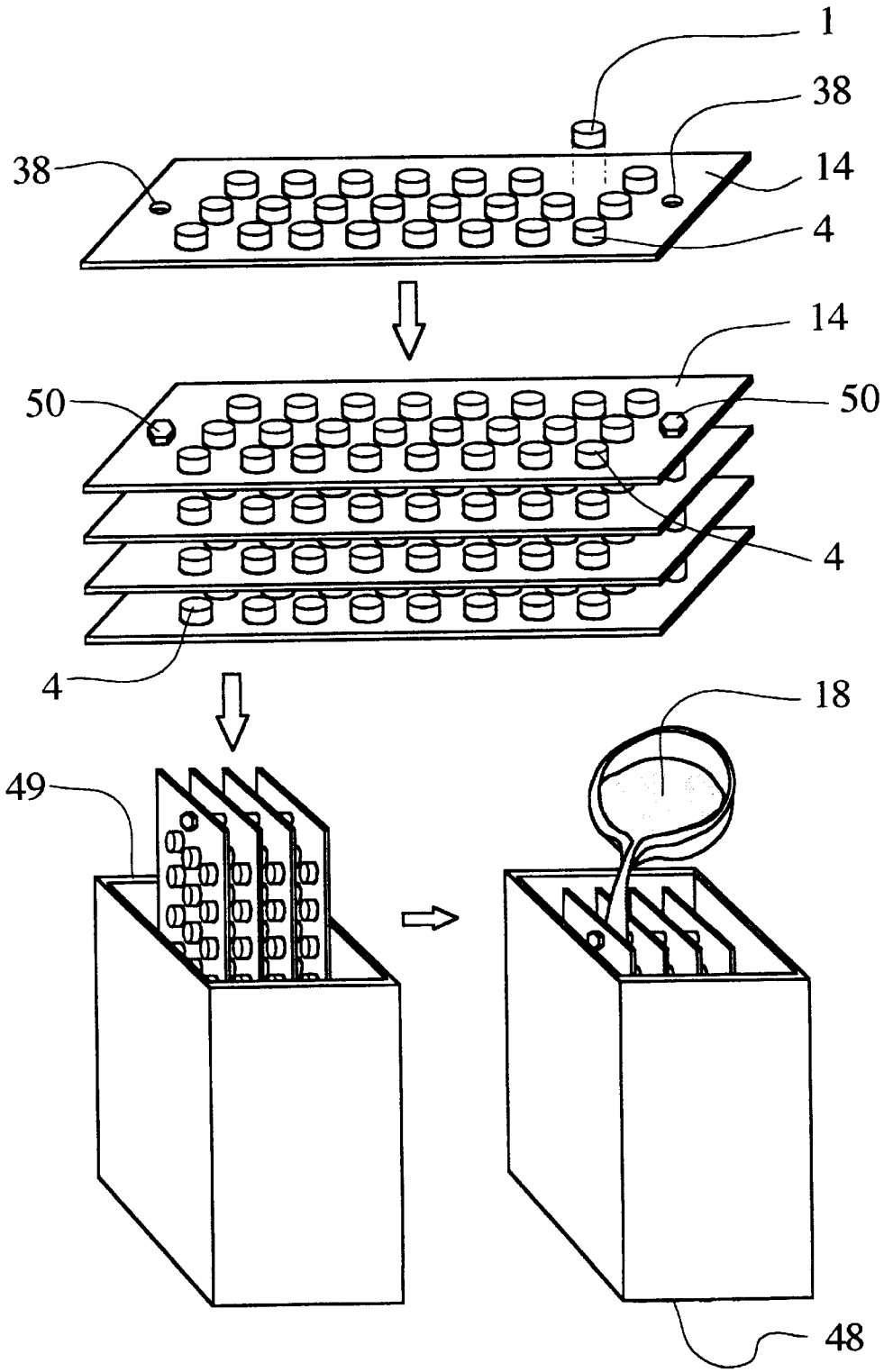
FIG. 16 shows the strabismal figure of an example of the procedure to produce the square tube type complex cell structure.

FIG. 16 shows the strabismal figure of an example of the procedure to produce the parallel square tube complex cell structure 48 using the flat plate maintained spatial surface 14. First, the thin, flat tin plate is prepared. Then, the cylindrical complex cell bodies 4 are distributed and bonded on the tin plate. Four of the bonded tin plates are produced and are layered and fixed to each other by nuts and bolts 50 through the nut-bolt hole 38. Next, this bolted plate is put into the steel, square tube vessel 49. Then, liquid concrete 18 is poured into the vessel. The vessel 49 is filled with the concrete 18 as coagulant. Finally the concrete 18 is coagulated to obtain the tube complex cell structure 48.

Figure 17:
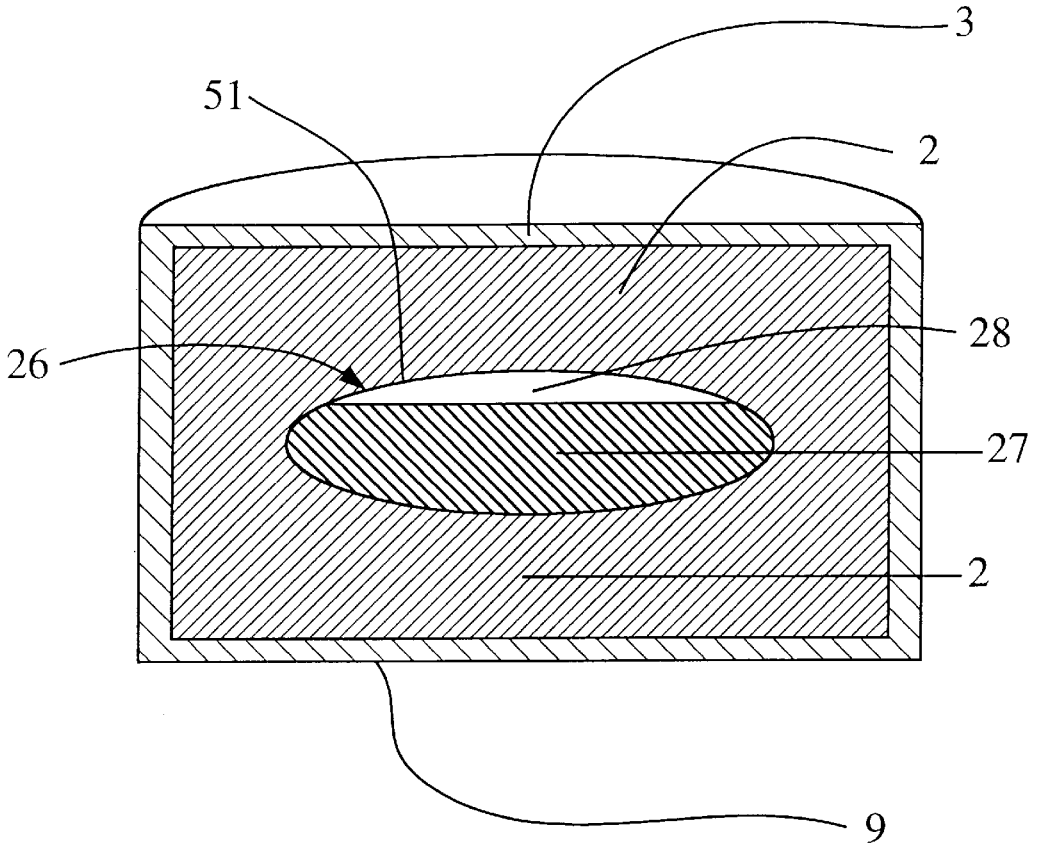
FIG. 17 shows the strabismal and cross section figures of an example of the complex cell body which contains liquid bags inside the cell.

FIG. 17 shows the strabismal and cross section figure of an example of the complex cell body which contains liquid bag 26 inside of the cell. This is a kind of canned complex cell body 9, including the liquid bag 26 in the light material 2. The liquid bag is wrapped by a plastic thinner plastic film bag 51, the bag is filled with water 27 and air 28. The out frame of the light material 2 is made from a thin can like layer to compose the canned complex cell body 9.

Figure 18:
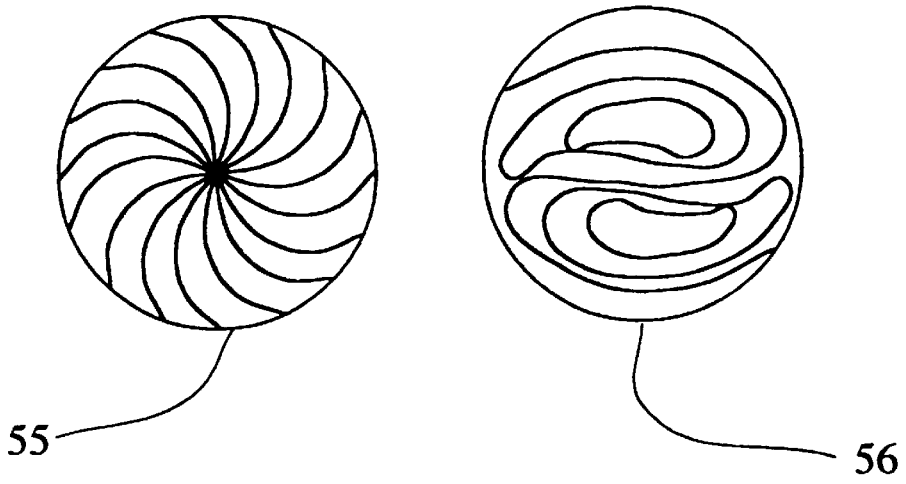
FIG. 18 shows the upper view of cross section figure of two examples of the spiral and whirlpool maintained spatial surface.

FIG. 18 shows the upper view of the cross section figure of two examples of the spiral and whirlpool shaped maintained spatial surface. In this figure, both one-pole whirlpool 55 and two-pole whirlpool type 56 plane maintaining bodies are shown.

Figure 19:
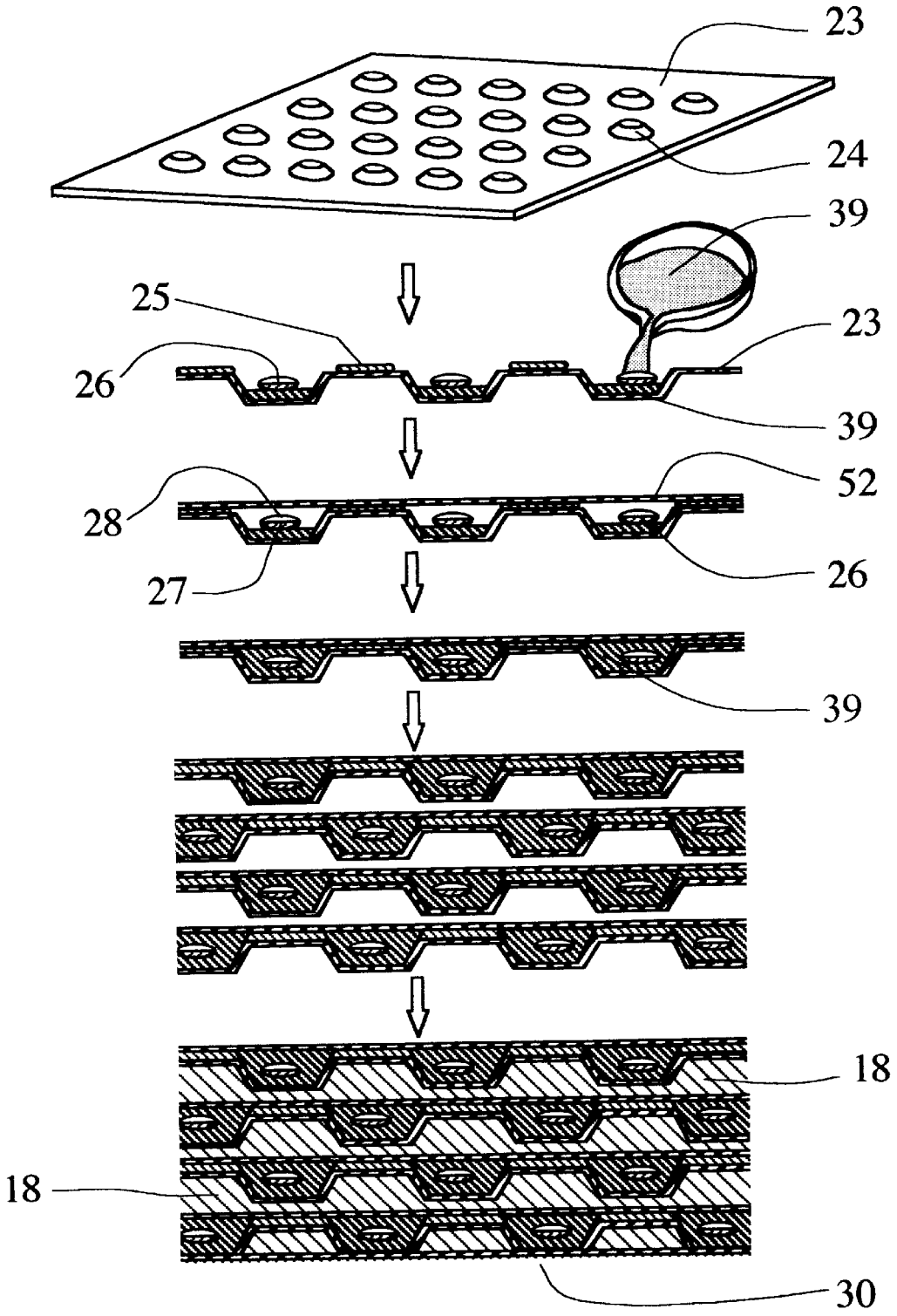
FIG. 19 shows an example of the procedure of making the plate type complex cell structure.

FIG. 19 shows an example of the procedure of making the plate complex cell structure 30 which contains the distributed the complex cell bodies. This contains the liquid bags 26 inside. First, the flat steel plate 23 is prepared. Then the mold is shown it's cross section has many trapezoid shaped cells and they are regularly distributed on the plate. The flat steel plate 23 is then pressed by the pressing machine using the mold to make indention of the trapezoid shape. Then the imprints 24 are produced. The pressed steel plate that has many of these indentions 24 is then produced. The thin plastic film liquid bags 51, whose sizes are smaller than that of the indentions size, is filled with water 27 and air 28, and are put in the indentions of the steel plate. Then the styrene foam resin 39 is placed in the indentions and at the same time the chemical adhesive 25 is spread on the convex areas of the flat steel plate 23. Then, it is concealed by the flat steel plate (it is not pressed, but is flat in shape) 52. The styrene foam 39 is then introduced. Three more plates are constructed using said procedure. The four plates are then stacked one upon the other. Liquid concrete 18 is poured into every empty space. It then coagulates. Finally the flat plate complex cell structure 30, which contains many liquid bags 26 inside, is produced.

Figure 20:
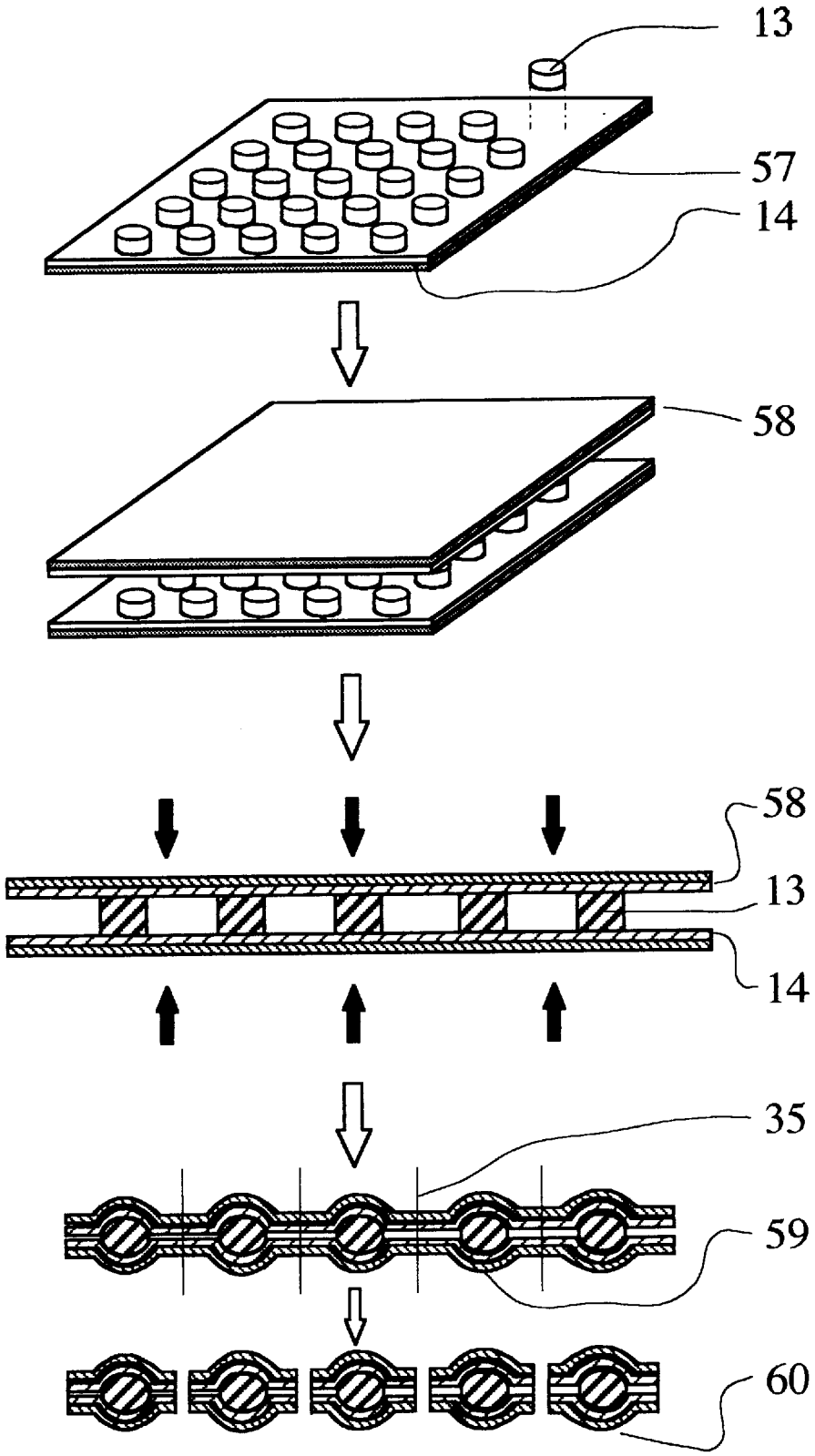
FIG. 20 shows an example of the procedure of making the compressed type complex cell structure.

FIG. 20 shows an example of the procedure of making compressed complex cell structure 60 by distributing the urethane foam resin 13 in a grid-like manner. First, the thin chemical film 57 on which the flat plate maintained spatial surface is already bonded to make the complex plate 58. Next, utheurethane foam resin 13 is distributed on the plate in a grid-like manner. It is then sandwiched by another plates. With the figure, in order to see more details, these plates are partially cut by a cross section. The plates are then compressed. The urethane foam is introduced. As it is explained above, the complex plate 59 is formed. The plate is then cut into pieces to alonF each grid line 35 as it is shown in the figure. After the cutting has occurred, many pieces of the sandwiched complex cell bodies 60 are produced.

INDUSTRIAL ADVANTAGE

This invention is composed as it is explained in detail above. There are many industrial advantages which are explained below. First of all, this invention's complex cell structure is a noble complex structure. It is a light, strong and tough structure. Also, from the production point of view, this structure is much easier to produce than the usual honeycomb structure. The use of formwork and complicated methods such as bending the material and binding it each others are not necessary processes any more. Thus, due to this invention, the industrial production of the complex cell structure, which contains numerous cells, becomes significantly easy. Therefore the cost, effort, labor, and time to produce it will be reduced considerably.

The new complex cell structure becomes stronger, tougher and even lighter than any other conventional structure. Even if large scale loading is forced on the structure, many complex cell bodies fill the structure, so a sudden collapse will not happen as is case with ordinary hollow honeycomb structures. Therefore, a dynamically tougher structure is realized.

Concerning the material of the structure, economical materials can be used as the prime material for making this structure such as steel plates, tin plates, concrete, urethane foam and styrene foam. Expensive materials such as duralumin or titanium, which are usually used for making honeycomb structure, are not used. Thus, the manufacturing cost can be reduced considerably.

According to the size, the thickness, the method of arranging and the density of the arranged complex cell bodies , which are distributed/bonded to the maintained spatial surface, and the coagulant character of the cement, any shape, size or density required by the structure can be attained. Also, by increasing or decreasing the number of rolled or stacked maintained spatial surfaces, the strength, weight, and toughness of the pillar or beam can be freely designated. This means that the invention makes it possible to plan the dynamic character of a structure. It's strength, weight and toughness can be calculated in advance. All kinds of light but tough structures such as slabs, pillars and beams can be manufactured.

Because the invention is used for constructing slabs, pillars and beams they become significantly lighter in weight. Carrying these objects becomes easier. Thus, the transportation cost is considerably reduced while moving these materials from one site to another.

Because the invention is used for constructing slabs, pillars and beams they become significantly lighter weight and have increased toughness. When this is applied to the construction of skyscrapers or long bridges, these buildings or bridges will become much taller or longer. This technology provides for structures to be produced at greater heights and lengths than ever thought possible.

The plates, beams and pillars using this invention's complex cell structure are produced at the factory. The made to order before construction begins. They can be sent to the construction site and filled with the cement at the site. Rolling or stacking of maintained spatial surface is not necessary. This step in the procedure has already been done. Construction at the site become easier. This produces an increase in work efficiency because construction has become more simplified.

The invention structure can be used for the body or roof of automobile and car. In this case, the weight of the automobile is reduced, and that the strength becomes higher. Therefore, an energy saving automobile is produced, because the gas mileage has been increased. Consequently, the environmental pollution can be reduced.

The side beams of an automobile can utilize this invention's structure. The structure absorbs loading energy when it is displaced. Because strength and the toughness increases in the car, if it crashes, the structure can sustain a heavier impact. Therefore, the automobile becomes safer for it's passengers.

A ship can be built using this invention's structure. By increasing the ratio of light material such as urethane form, the structure's specific gravity becomes lighter than water. Thus, even if the ship takes on water, the structure itself can float When it is used for the segments of under water tunnel or water tube, the structure itself can float, thus it becomes safer. Also, the invention can provide for ocean structures, such as floating airports and large floating structure such as ocean cities or platforms.

The invention of complex cell structure can be used for any structure. Because the cell structure contains the foamed material, it can contain a higher ratio of gas. Therefore, the absorbing energy ratio becomes higher. This results in higher dampening or soundproof effects especially when used for making panels or plates. In the case of using liquid replacing instead of gas, an even higher dampening effect is expected.

As the invention structure contains more gas inside the complex cell bodies, the heat transfer ratio becomes lower and heat insulation increases.

When the structure is built by many complex cell bodies, the inner hysteresis increases. Therefore, the structure can absorb noise and vibration. For example, an increased control of vibration can be expected when applied to automobile materials. A quieter automobile can be constructed.

The invention structure has an essential higher structural dampening effect Therefore a building using the invention structure increases resistance to shaking such as earthquake. When the liquid is used in the complex cell body, it's resistance increases even more. The structural dampening effect is produced by the liquid's absorption of more vibrations. This is more applicable to buildings requiring a higher resistance to earthquake. Also, this invention is applicable when constructing quieter buildings and houses, because of it's higher soundproof effect.

Due to the structural and procedural simplicity, it is easily produced in the manufacturing plant and a high quality structure can be expected.

We claim:

1. A complex cell structure, including a maintained spatial surface, which is made of rigid material, a plurality of complex cell bodies each having an interior portion comprised of a light weight material and a brim having at least one surface made from a rigid material, wherein the complex cell bodies are distributed and bonded on the maintained spatial surface so that they are spaced apart from one another by a gap space, and further wherein the shape of the maintained spatial surface, on which the complex cell bodies are distributed, is rolled shaped, annular ring shaped, whirlpooled shaped, laminated shaped, plate shaped or crossed shaped, and further wherein at least the gap space between the complex cell bodies along the maintained spatial surface is filled with coagulant.

2. The complex cell structure of claim 1, wherein the light material is formed of at least more than one kind of foaming agent, plastics or any combination thereof.

3. The complex cell structure of claim 1 wherein the coagulant is formed of at least more than one kind of concrete, cement mortar or gypsum or any combination thereof.

4. The complex cell structure of claim 1, wherein the maintained spatial surface is formed of at least more than one kind of metal plate, plastic plate, fiber sheet, dense molecular plastic material sheet or any combination thereof.

5. The complex cell structure of claim 1, wherein the maintained spatial surface includes a notch or an opening.

6. The complex cell structure of claim 1, wherein the rigid material for the brim is formed of at least more than one kind of metal thin plate, metal film, can, plastic plate, fiber sheet or any combination thereof.

7. The complex cell structure of claim 1, wherein the maintained spatial surface includes a spacer.

8. The complex cell structure as of claim 1, which is put in a rigid tube.

9. The complex cell structure as of claim 1, which is sandwiched between more than two rigid plates.

10. The complex cell structure as of claim 1, which contains a liquid bag which holds at least a liquid.

11. Said rigid tube which is described in claim 8, is made from metal or other materials which have strength against tensile forces.

12. Said rigid plate which is described in claim 9, is made from a metal or other materials which have strength against tensile forces.

13. A complex cell structure, comprising a maintained spatial surface, which is made of rigid material, a plurality of complex cell bodies each having an interior portion comprised of a light weight material and a brim having at least one surface made from a material which is strong against tensile forces, wherein the complex cell bodies are distributed and bonded on the maintained spatial surface so that they are spaced apart from one another by a gap space, and further wherein the gap space along the maintained spatial surface between the complex cell bodies is filled with coagulant which is strong against compressive forces and the coagulant is reinforced by the brims of the plurality of complex cell bodies.

14. A complex cell structure, comprising a maintained spatial surface, which is made of a material which has strength against tension forces, a plurality of complex cell bodies each having an interior portion comprised of a light weight material and a boundary portion having at least one surface made from a material which is strong tensile material, wherein the complex cell bodies are spaced apart and bonded on the maintained spatial surface so that they are separated from one another by a gap space, and a coagulant material, which is strong against compressive forces, which fills the gap space along the maintained spatial surface between the complex cell bodies, wherein the boundary portions of the plurality of complex cell bodies reinforce the coagulant material to strengthened the coagulant material against dynamic forces.

15. A column comprising an outer tube made of a material which has strength against tensile forces, a plurality of annual ring shaped maintained spatial surfaces positioned coaxially in the outer tube, each having a different diameter and made of a material which has strength against tension forces, a plurality of complex cell bodies distributed and bonded to a face of each of the plurality of annul ring shaped maintained spatial surfaces so that there are gap spaces between the plurality of complex cell bodies, wherein each of the plurality of complex cell bodies has an interior portion of a light weight material and a boundary portion having at least one surface made from a material which is strong against tensile forces, a coagulant material, which is strong against compressive forces and which fills any spaces between the complex cell bodies, the plurality of annual ring shaped maintained spatial surfaces, and the outer tube, including the gap spaces between the complex cell bodies, wherein the boundary portions of the plurality of complex cell bodies reinforce the coagulant material to strengthened the coagulant material against dynamic forces.

16. A process at least comprising the following steps to produce complex cell bodies for use in the complex cell structures of claim 1, a. forming a tube complex structure by bonding a rigid thin plate onto a side face of a pillar shaped light weight material, or by placing foaming resin inside a cylindrical or square tube to fill the cylindrical or square tube, b. cutting the tube complex structure transverse to a longitudinal axis of the tube complex structure to form the complex cell bodies.

17. A process at least comprising the following steps to produce complex cell bodies for use in the complex cell structures of claim 1, a. bonding a rigid thin plate on at least one face of a light weight material to form a complex structure, b. cutting the complex structure transverse to the rigid thin plate and the at least one face of the light weight material to provide complex cell bodies having cross sectional shapes of triangles, rectangles, pentagons, hexagons or ovals.

18. A process at least comprising the following steps to produce a plurality of sandwiched complex cell bodies for use in the complex cell structure of claim 1, a. bonding a plastic thin film on at least one face of a first plate shaped maintained spatial surface, b. distributing a plurality of foaming resin bodies in a grid-like manner on the first plate shaped maintained spatial surface, c. forming a sandwich structure by positioning a second plate shaped maintained spatial surface so that the distributed foaming resin bodies are sandwiched between the first and second plate shaped maintained spatial surfaces, d. foaming the foaming resin, e. cutting the sandwich structure in a grid like manner to provide the plurality of sandwiched complex cell bodies.

19. A process at least comprising the following steps to produce a plurality of sandwiched complex cell bodies for use in the complex cell structure of claim 1, a. bonding a plastic thin film on at least one face of a first plate shaped maintained spatial surface, b. distributing a plurality of foaming resin bodies in a grid-like manner on the first plate shaped maintained spatial surface, c. forming a sandwich structure by positioning a second plate shaped maintained spatial surface so that the distributed foaming resin bodies are sandwiched between the first and second plate shaped maintained spatial surfaces, d. foaming the foaming resin, e. compressing the sandwich structure in a grid like manner to provide the complex cell structure having a plurality of sandwiched complex cell bodies.

20. A process at least comprising the following steps to produce the complex cell structure of claim 1 which employs maintained spatial surfaces on which complex cell bodies have been distributed and bonded and which have been rolled or stacked into an annual ring shape, a. inserting the annual ring shaped maintained spatial surfaces into a tube or can, b. filling the tube or can with a liquid coagulant, c. coagulating the coagulant.

21. A process at least comprising the following steps to produce the complex cell structure of claim 1 which employs plate shaped maintained spatial surfaces on which complex cell bodies have been distributed and bonded, a. stacking the plate shaped maintained spatial surfaces to form a multilayered shape, b. filling the spaces between the stacked plate shaped maintained spatial surfaces with a liquid coagulant, c. coagulating the coagulant.

22. A process at least comprising the following steps to produce the complex cell structure of claim 1 which employs maintained spatial surfaces on which complex cell bodies have been distributed and bonded, a. prior to bonding the complex cell bodies to the maintained spatial surfaces, shaping the complex cell bodies to conform to the contour of the maintained spatial surfaces, b. filling the spaces between the maintained spatial surfaces with a liquid coagulant, c. coagulating the coagulant.

23. A method for constructing a complex cell structure having increased dynamic strength, comprising the steps of forming a plurality of complex cell bodies each having an interior portion comprised of a light weight material and a boundary portion having at least one surface made from a material which is strong against tensile forces, distributing and bonding the complex cell bodies onto a maintained spatial surface so that they are spaced apart from one another by a gap space, wherein the maintained spatial surface is made of rigid material, and filling the gap space along the maintained spatial surface between the complex cell bodies with a coagulant which is strong against compressive forces, so that the coagulant is reinforced by the boundary portions of the plurality of complex cell bodies.

* * * * *